US010562336B2

(12) United States Patent
Horn

(10) Patent No.: US 10,562,336 B2
(45) Date of Patent: Feb. 18, 2020

(54) BINDER APPARATUS

(71) Applicant: Hans Johann Horn, Bern (CH)

(72) Inventor: Hans Johann Horn, Bern (CH)

( * ) Notice: Subject to any disclaimer, the term of this patent is extended or adjusted under 35 U.S.C. 154(b) by 0 days.

(21) Appl. No.: 16/114,507

(22) Filed: Aug. 28, 2018

(65) Prior Publication Data

US 2018/0361779 A1 Dec. 20, 2018

Related U.S. Application Data

(63) Continuation of application No. 13/839,608, filed on Mar. 15, 2013, now Pat. No. 10,086,639.

(51) Int. Cl.
*B42F 13/26* (2006.01)

(52) U.S. Cl.
CPC ..... *B42F 13/26* (2013.01)

(58) Field of Classification Search
CPC ..... B42F 13/26
(Continued)

(56) References Cited

U.S. PATENT DOCUMENTS 1,439,367 A 12/1922 Krag
1,440,394 A 1/1923 Krag
(Continued)

FOREIGN PATENT DOCUMENTS

GB 2292343 2/1996
JP 1299095 12/1989
JP 10217662 8/1998

OTHER PUBLICATIONS

United States Patent and Trademark Office, "Notice of Allowance," issued in connection with U.S. Appl. No. 29/458,039, dated Jul. 25, 2014, 9 pages.

(Continued)

*Primary Examiner* — Justin V Lewis
(74) *Attorney, Agent, or Firm* — Hanley, Flight & Zimmerman, LLC

(57) ABSTRACT

An example binder apparatus is disclosed. An example binder apparatus includes a housing having a first side surface, a second side surface, and an inner central surface extending between the first side surface and the second side surface. The example binder apparatus also includes a first carrier rail including a first longitudinal edge and a second longitudinal edge, the first carrier rail including a first tab to extend away from the inner central surface of the housing, the first longitudinal edge disposed adjacent the first side surface of the housing. The example binder apparatus also includes a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingably engaging the fourth longitudinal edge. In addition, the example binder apparatus includes a slider including a locking block extending therefrom, the locking block disposed in a space between the first tab and the second tab when the binder apparatus is in a closed position and the locking block is disposed outside of the space between the first tab and the second tab when the binder apparatus is in an open position.

17 Claims, 30 Drawing Sheets

(58) Field of Classification Search
USPC ..... 402/19, 20, 21, 26, 27, 31, 35, 36, 38, 402/39, 41
See application file for complete search history.

(56) References Cited

U.S. PATENT DOCUMENTS

| | | | | |
|---|---|---|---|---|
| 2,013,416 | A | 9/1935 | McClure | |
| 4,566,817 | A | 1/1986 | Barrett, Jr. | |
| 4,571,108 | A | 2/1986 | Vogl | |
| D295,422 | S | 4/1988 | Erickson | |
| 4,919,557 | A | 4/1990 | Podosek | |
| 5,975,785 | A | 11/1999 | Chan | |
| D419,054 | S | 1/2000 | Curwood | |
| D430,204 | S | 8/2000 | Berracasa | |
| 6,142,697 | A | 11/2000 | Williams | |
| 6,276,862 | B1 | 8/2001 | Snyder et al. | |
| 6,840,695 | B2 | 1/2005 | Horn | |
| 6,916,134 | B2 | 7/2005 | Wong | |
| D529,548 | S | 10/2006 | Kaneda | |
| 7,134,800 | B2 | 11/2006 | Kaneda | |
| 7,275,886 | B2 | 10/2007 | Cheng | |
| 7,293,932 | B2 | 11/2007 | Wong | |
| 7,461,994 | B2 | 12/2008 | Whaley | |
| D588,443 | S | 3/2009 | Kelleghan | |
| 7,524,127 | B2 | 4/2009 | Petrie et al. | |
| D592,939 | S | 5/2009 | Kelleghan | |
| 7,534,064 | B2 | 5/2009 | Cheng | |
| 7,648,302 | B2 | 1/2010 | Zhang et al. | |
| 7,661,898 | B2 | 2/2010 | Ng et al. | |
| 7,661,899 | B2 | 2/2010 | Lin | |
| 7,665,926 | B2 | 2/2010 | Cheng | |
| 7,704,005 | B2 | 4/2010 | Lin | |
| 7,717,638 | B2 | 5/2010 | Harris et al. | |
| 7,726,897 | B2 | 6/2010 | To et al. | |
| 7,731,441 | B2 | 6/2010 | Ng et al. | |
| 7,744,300 | B2 | 6/2010 | Cheng et al. | |
| 7,758,271 | B2 | 7/2010 | Cheng | |
| 7,828,491 | B2 | 11/2010 | Cheng | |
| 8,330,669 | B2 | 12/2012 | Cornwall et al. | |
| 8,517,624 | B2 | 8/2013 | Warmus | |
| D718,811 | S | 12/2014 | Horn | |
| 10,086,639 | B2 | 10/2018 | Horn | |
| 2005/0201818 | A1 | 9/2005 | Cheng | |
| 2005/0271459 | A1 | 12/2005 | To et al. | |
| 2006/0228164 | A1* | 10/2006 | Horn ..... | B42F 13/26 402/31 |
| 2008/0075527 | A1 | 3/2008 | Pi et al. | |
| 2008/0080926 | A1 | 4/2008 | Liu et al. | |
| 2009/0060631 | A1 | 3/2009 | To et al. | |
| 2009/0274508 | A1 | 11/2009 | Zhang et al. | |
| 2010/0232867 | A1 | 9/2010 | Ng et al. | |
| 2011/0170947 | A1 | 7/2011 | Zheng et al. | |
| 2012/0121317 | A1 | 5/2012 | Warmus | |
| 2014/0270903 | A1 | 9/2014 | Horn | |

OTHER PUBLICATIONS

United States Patent and Trademark Office, "Final Office Action," issued in connection with U.S. Appl. No. 29/458,039, dated Feb. 21, 2014, 7 pages.
United States Patent and Trademark Office, "Office Action," issued in connection with U.S. Appl. No. 29/458,039, dated Sep. 12, 2013, 15 pages.
United States Patent and Trademark Office, "Advisory Action," issued in connection with U.S. Appl. No. 29/458,039, dated May 22, 2014, 3 pages.
United States Patent and Trademark Office, "Non-Final Office action" issued in connection with U.S. Appl. No. 12/945,370, dated Nov. 30, 2012, 18 pages.
United States Patent and Trademark Office, "Notice of Allowance" issued in connection with U.S. Appl. No. 12/945,370, dated Apr. 29, 2013, 15 pages.
United States Patent and Trademark Office, "Non-Final Office Action," issued in connection with U.S. Appl. No. 13/839,608, dated Aug. 7, 2014, 15 pages.
United States Patent and Trademark Office, "Non-Final Office Action," issued in connection with U.S. Appl. No. 13/839,608, dated Apr. 3, 2015, 17 pages.
United States Patent and Trademark Office, "Final Office Action," issued in connection with U.S. Appl. No. 13/839,608, dated Oct. 29, 2015, 25 pages.
United States Patent and Trademark Office, "Non-Final Office Action," issued in connection with U.S. Appl. No. 13/839,608, dated Nov. 17, 2016, 19 pages.
United States Patent and Trademark Office, "Final Office Action," issued in connection with U.S. Appl. No. 13/839,608, dated Jun. 7, 2017, 27 pages.
United States Patent and Trademark Office, "Non-Final Office Action," issued in connection with U.S. Appl. No. 13/839,608, dated Oct. 30, 2017, 21 pages.
United States Patent and Trademark Office, "Advisory Action," issued in connection with U.S. Appl. No. 13/839,608, dated Feb. 19, 2016, 3 pages.
United States Patent and Trademark Office, "Advisory Action," issued in connection with U.S. Appl. No. 13/839,608, dated Aug. 3, 2017, 3 pages.
United States Patent and Trademark Office, "Notice of Allowance," issued in connection with U.S. Appl. No. 13/839,608, dated May 31, 2018, 17 pages.

* cited by examiner

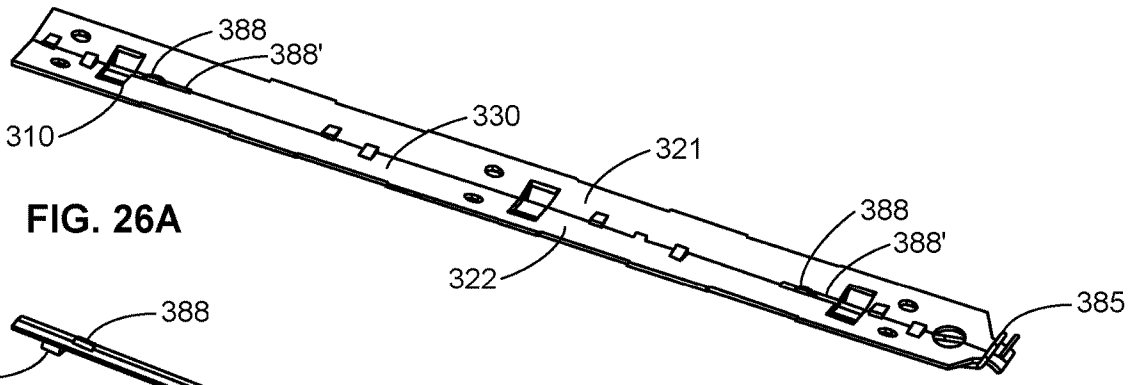
FIG. 26A
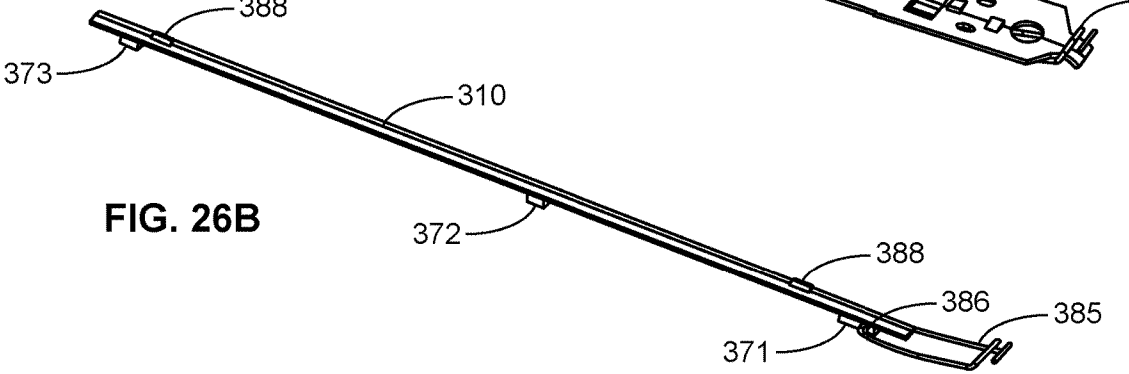
FIG. 26B
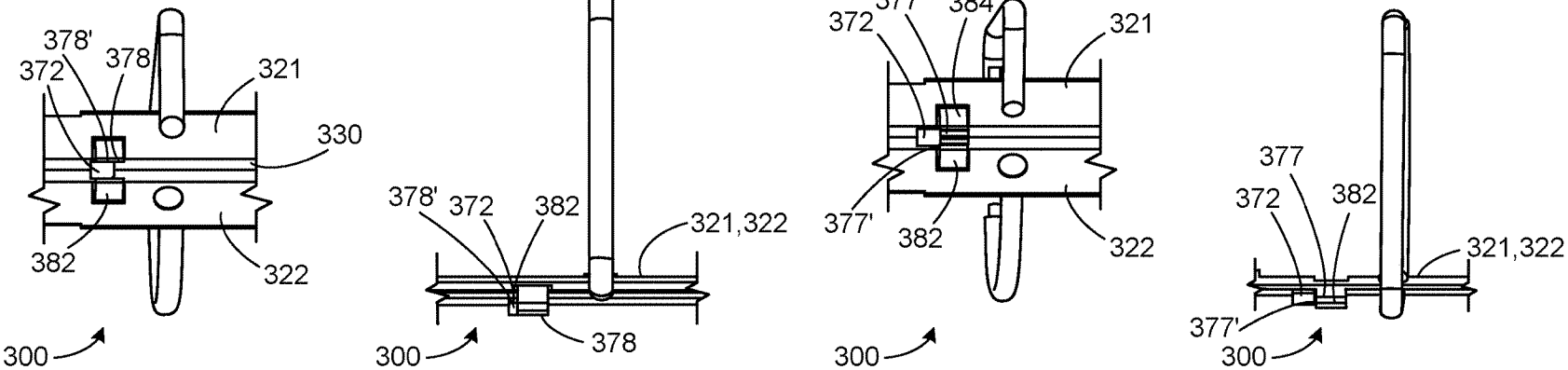
FIG. 26C
FIG. 26D
FIG. 26E
FIG. 26F

BINDER APPARATUS

RELATED APPLICATION

This patent arises from a continuation of U.S. application Ser. No. 13/839,608, titled "Binder Apparatus," and filed Mar. 15, 2013, now U.S. Pat. No. 10,086,639. U.S. application Ser. No. 13/839,608 is hereby incorporated herein by this reference in its entirety.

FIELD OF THE DISCLOSURE

This patent relates to binders and, more specifically, to binder apparatus.

BACKGROUND

Binders are used to store loose leaf pages, documents, other materials, etc.

BRIEF DESCRIPTION OF THE DRAWINGS

FIG. 26A depicts a perspective view of the carrier rails, the slider and an intermediate connector element of the binder apparatus of FIGS. 19A-19D.

FIG. 26B depicts a perspective view of the slider and the intermediate connector of the binder apparatus of FIGS. 19A-19D.

FIG. 26C depicts a partial bottom view of the carrier rails and the slider of the binder apparatus of FIGS. 19A-19D in the closed position.

FIG. 26D depicts a partial side elevational view of the carrier rails and the slider of the binder apparatus of FIGS. 19A-19D in the closed position.

FIG. 26E depicts a partial bottom view of the carrier rails and the slider of the binder apparatus of FIGS. 19A-19D in the opened position.

FIG. 26F depicts a partial side elevational view of the carrier rails and the slider of the binder apparatus of FIGS. 19A-19D in the opened position.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples disclosed herein relate to binder apparatus that enable closure members to be relatively easily transitioned and/or secured in either the open position or the closed position. More specifically, the examples disclosed herein enable carrier rails of the binder apparatus to be locked in and/or transitioned between either the open and/or closed positions using a housing, a lever assembly, a movable slider and carrier rails. The housing has an interior surface and an exterior surface, and the carrier rails have an interior surface and an interior surface, oriented such that the interior surface of the carrier rails face the interior surface of the housing, and the exterior surface of the carrier rails face away from the interior surface of the housing. In some examples, the slider has locking element(s) that are spaced apart from the exterior surface of the carrier rails and tapered lateral surfaces of the locking elements engage opposing tabs formed by stamping the carrier rails such that the interior surfaces of the carrier rails define faces of the tabs and face one another. In contrast to some known binders, some examples disclosed herein include a slider directly coupled to a lever without an intermediate connector. Thus, the carrier rails can be either opened and/or closed using fewer parts.

Figure 1A:
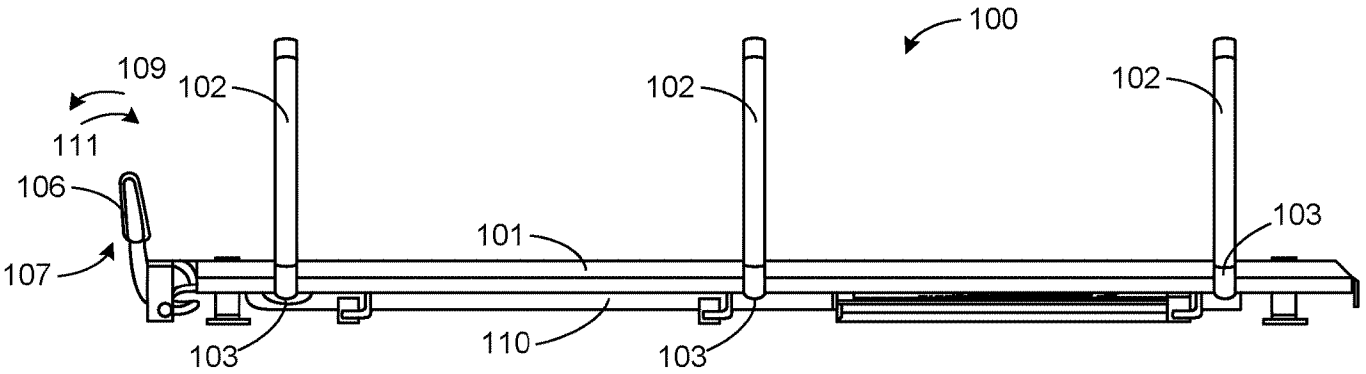
FIGS. 1A-1D depict a side elevational view, a top view, an end elevational view, and a perspective bottom view of an example binder apparatus in a closed position.
Figure 1B:
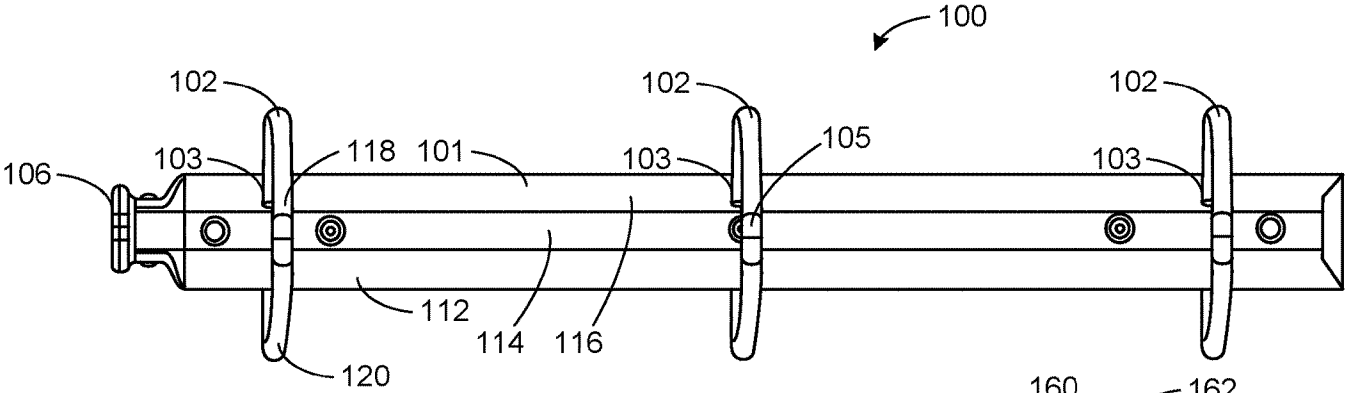

FIGS. 1A, 1B, 1C, and 1D show an example binder apparatus and/or binder 100 that may be used to store loose leaf pages, documents, other materials, etc. In this example, the binder 100 includes a housing 101, one or more closure members 102 extending through openings 103 in the housing 101, and a slider 110. The closure members 102 cooperate pairwise to form at least one ring 105 (FIG. 1B). The binder 100 also includes a lever or actuating assembly 107 that may be actuated to open and close the closure members 102. Specifically, to open the closure members 102, a lever 106 of the lever assembly 107 is moved in a direction generally represented by arrow 109 and, to close the closure members 102, the lever 106 is moved in a direction generally represented by arrow 111. However, the lever assembly 107 may be differently configured to open and/or close the closure members 102.

Figure 1C:
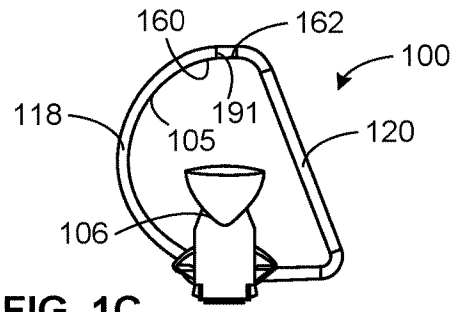

The housing 101 includes a first side or portion 112, a second side or portion 114, and a third side or portion 116. The second side 114 is coupled to and positioned between the first side 112 and the third side 116. As shown in FIG. 1C, each of the closure members 102 includes a first portion or section 118 and a second portion or section 120. The first and second portions 118 and 120 engage and/or interact to form respective rings 105 that enable documents, papers, etc. to be stored within the binder 100. In the illustrated example, the second portion 120 defines a groove 191 (FIG. 1C) that receives an end of the first portion 118 such that a surface 160 of the first portion 118 is substantially flush and/or in-line with a surface 162 of the second portion 120 even as the portions 118, 120 move toward the open position, thereby substantially preventing a step from forming between the portions 118, 120 that could catch on papers in the binder 100. In some examples, the closure members 102 may be different than shown in FIGS. 1A-1C. For example, the first and/or second portions 118 and 120 may be differently curved, have different ends, may both be similar to one another, may form a ring or any other closed shaped, etc.

Figure 1D:
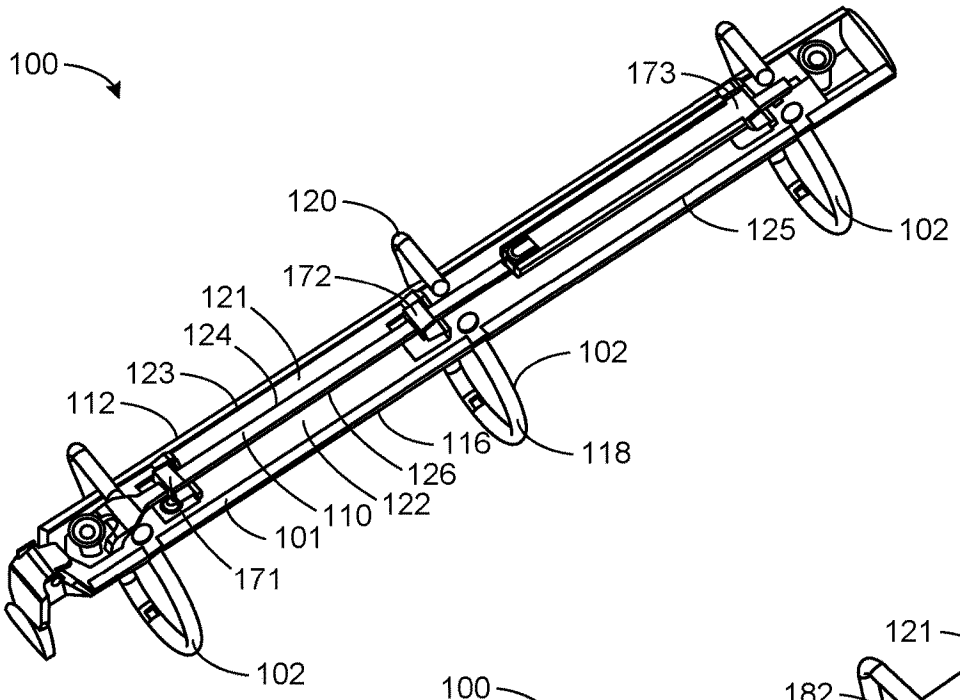
Figure 1E:
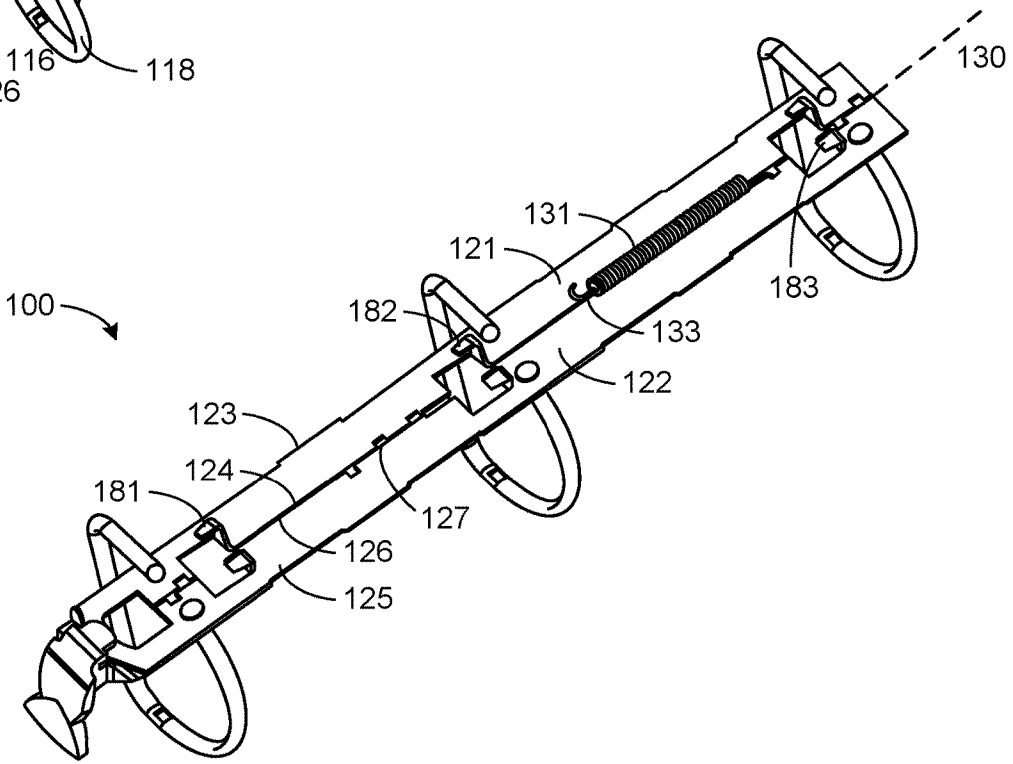
FIG. 1E depicts a perspective bottom view of the binder apparatus of FIGS. 1A-1D in the closed position without the housing.

FIGS. 1D and 1E show alternative views of the example binder 100, where FIG. 1D shows a bottom perspective of the example binder 100 with the housing 101 and the slider 110 and FIG. 1E shows a bottom perspective of the example binder 100 with the housing 101 and the slider 110 removed for illustrative purposes. The housing first and third sides 112 and 116 may have a cross sectional shape forming housing flanks (e.g., curved edges) to at least partially retain carrier rails 121 and 122 in the housing 101. The closure members 102 are respectively coupled to the carrier rails 121, 122. The first carrier rail 121 includes a first longitudinal edge 123 biased by the first side 112 of the housing 101 and a second longitudinal edge 124 that includes a plurality of notches or engaging pieces 127. The second carrier rail 122 includes a third longitudinal edge 125 biased by the third side 116 of the housing 101 and a fourth longitudinal edge 126 that includes a plurality of notches or engaging pieces 127. In other examples, one or neither of the first or second carrier rails 121 and 122 includes the notches or engaging pieces 127. The second longitudinal edge 124 and the fourth longitudinal edge 126 may be hingably coupled via the plurality of corresponding notches or engaging pieces 127, for example.

Figures 2A, 3A:
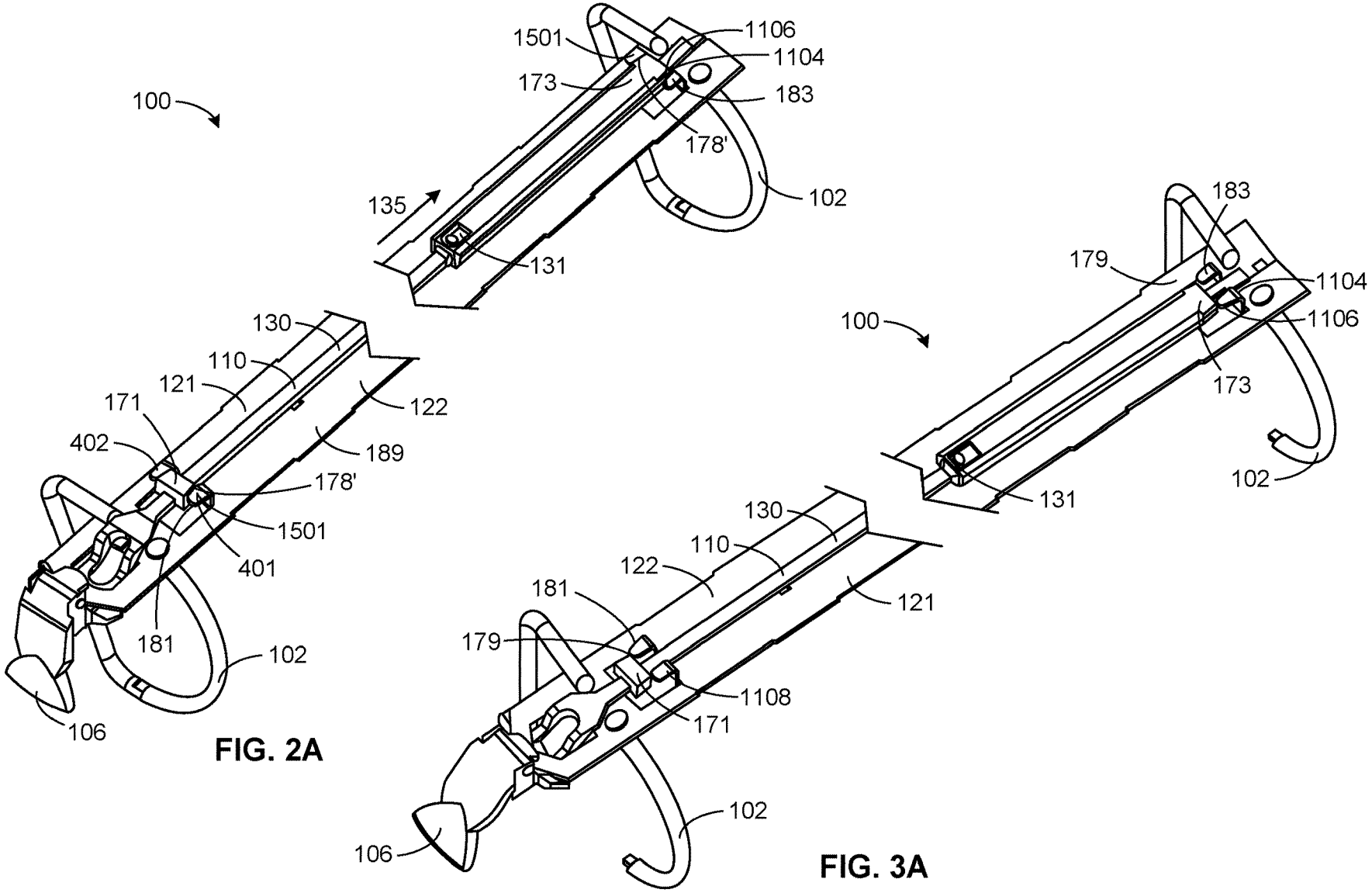
FIGS. 2A-2C depict a perspective bottom view, a side elevational side view and an end elevational view of the binder apparatus of FIGS. 1A-1D in the closed position without the housing.
FIGS. 3A-3C depict a perspective bottom view, a side elevational side view and an end elevational view of the binder apparatus of FIGS. 1A-1D in the open position without the housing.

FIGS. 2A and 3A show bottom views of partial sections of the binder 100 without the housing 101. FIG. 2A shows the binder 100 in a closed position. FIG. 3A shows the binder 100 in an open position. As shown in FIG. 2A, the carrier rails 121, 122 include bulges, tabs and/or detents 181, 182, 183 that extend substantially perpendicularly from a surface and/or face 189 of the carrier rails 121, 122. While the example illustrated in FIG. 2A illustrates the bulges 181, 182, 183 as being bent from the carrier rails 121, 122, in other examples, additional material may be deposited and/or molded on the carrier rails 121, 122 to form the bulges 181, 182, 183, which perform the functions of the dents 181, 182, 183, 281, 282, 283, 381, 832, 383 as disclosed herein. In some examples, the tabs 181, 182, 183 include surfaces 401, 402 such that a distance between first ends 1104 of the tabs 181, 182, 183 are closer and/or less than a distance between second ends 1106 of the tabs 181, 182, 183.

To secure the binder 100 in the closed position, the inward tapered surfaces 401, 402 of the detents 181, 182, 183 are engaged by lateral faces, surfaces and/or edges 178' of locking blocks and/or elements 171, 172, 173 such that the locking blocks 171, 172, 173 are positioned between the detents 181, 182, 183 and prevent ends 1501 of the detents 181, 182, 183 from moving toward each other and, in turn, open the closure members 102. In some examples, when the locking blocks 171, 172, 173 are positioned between the detents 181, 182, 183, a majority and/or a substantial portion of the tapered surfaces 178' engage the inward facing surfaces 401, 402 of the detents 181, 182, 183. Such engagement 181, 182, 183 may increase the locking force between the locking blocks 171, 172, 273 and the detents 181, 182, 183, thereby substantially ensuring the closure members 102 of the binder 100 does not inadvertently open. As shown in FIG. 3A, to enable the binder 100 to be in and/or move toward the open position, the locking blocks 171, 172, 173 are spaced from being between the detents 181, 182, 183 to enable the ends 1501 of the detents 181, 182, 183 to move toward each other and, in turn, open the closure members 102.

As shown in FIG. 2A, a spring 131 is connected to the slider 110 and at least one carrier rail 121, 122 and/or the housing 101. The spring 131 provides a pulling force in a direction generally indicated by arrow 135 that urges the slider 110 to move toward the closed position when the slider 110 is in the open position and/or not in the closed position.

Figure 2C:
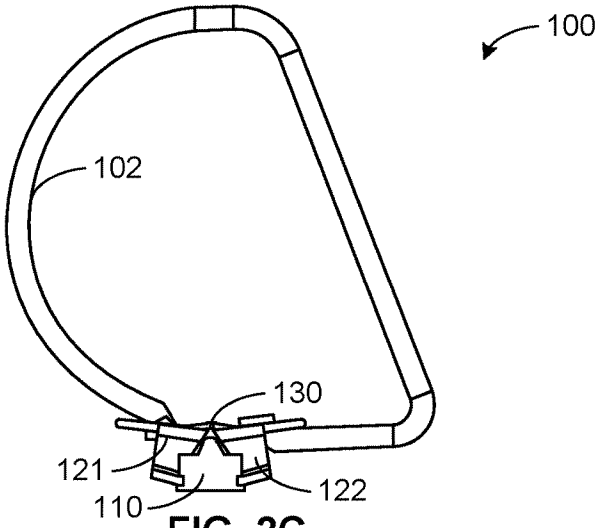
Figure 3C:
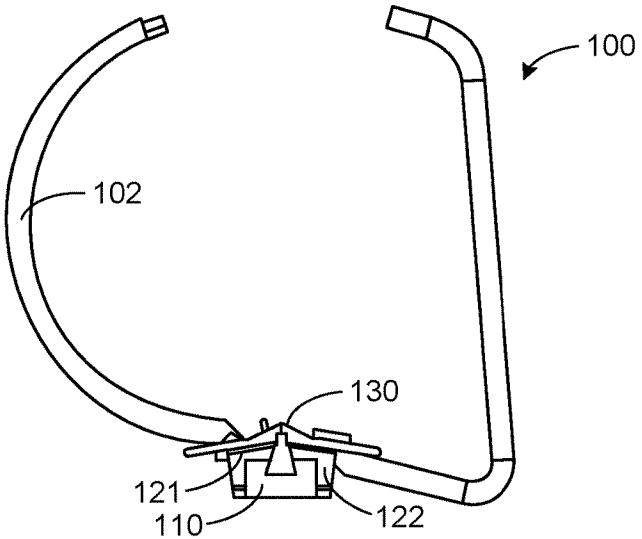
Figure 2B:
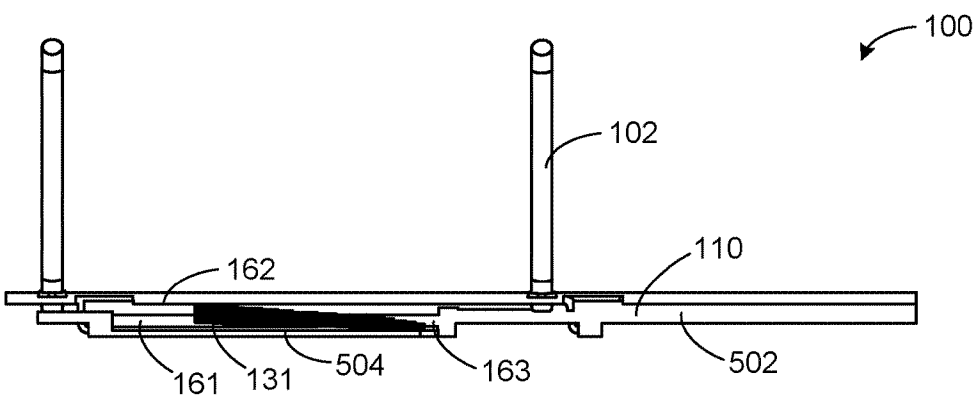
Figure 3B:
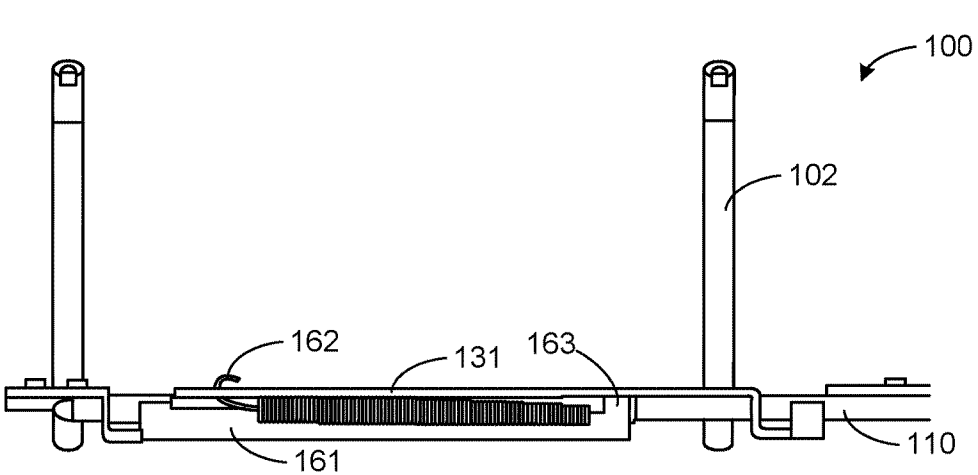

FIGS. 2B and 3B show cross-sectional side views of the binder 100 in closed and opened configurations and/or positions. In some examples, the spring 131 is at least partially positioned within a compartment, housing and/or groove 161 defined by the slider 110. In some examples, the slider 110 includes a first portion 502 defining the first and second locking blocks 171, 172, and a second portion 504 defining the groove 161 and the third locking element 173. In some examples, positioning the spring 131 within the groove 161 substantially aligns axes of the spring 131 and the slider 110 and/or the spring 131 from interfering with each other, etc. In some examples, a first end 162 of the spring 131 is connected to at least one of the carrier rails 121, 122, and a second end 163 of the spring 131 is connected to the slider 110. In other examples, the first end 162 can be coupled to the housing 101. As shown in FIG. 2B, when the binder 100 is in a closed configuration, the spring 131 is in a first position. As shown in FIG. 3B, when the binder 100 is in an opened configuration, the spring 131 is in a second position.

FIG. 2C shows an end view of the closure members 102, the carrier rails 121, 122 and the slider 110. When the carrier rails 121, 122 are displaced and/or pivoted about a pivot and/or axis 130, the closure members 102 are actuated between the closed and opened positions.

Figure 3D:
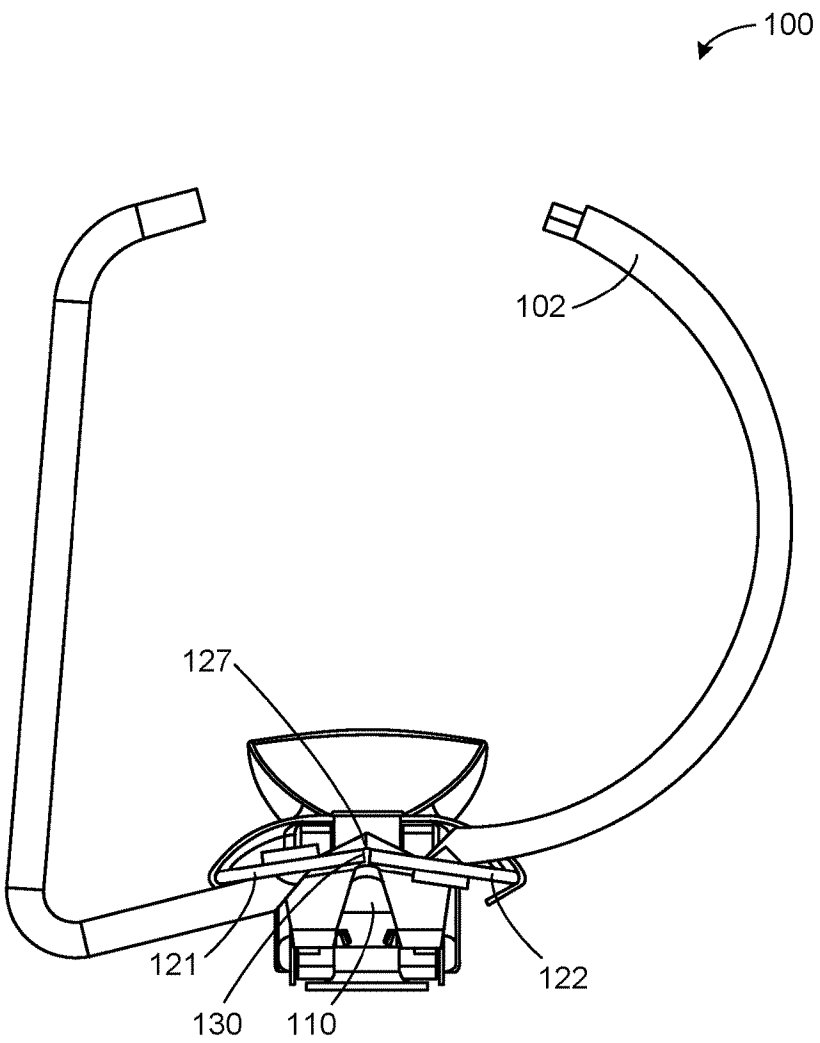
FIG. 3D depicts an enlarged end elevational view partially in section of the binder apparatus of FIGS. 1A-1D in the open position.
Figure 2D:
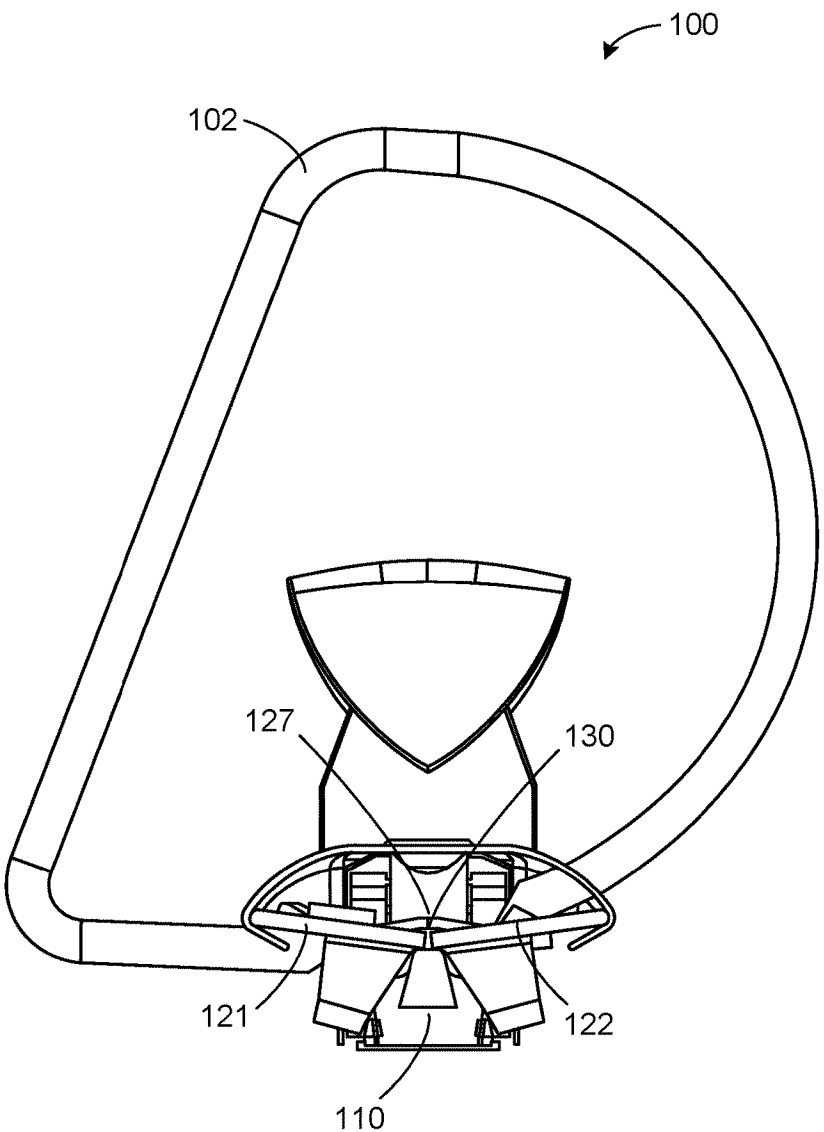
FIG. 2D depicts an enlarged end elevational view, partially in section, of the binder apparatus of FIGS. 1A-1D in the closed position.

FIGS. 2D and 3D show an end view of the binder 100 in closed and opened configurations with the housing 100, the carrier rails 121, 122, and the closure members 102. In both the opened and closed positions shown in FIGS. 2D and 3D, the carrier rails 121, 122 are hingably coupled about the longitudinal axis 130 via the plurality of corresponding notches or engaging elements 127.

Figure 4B:
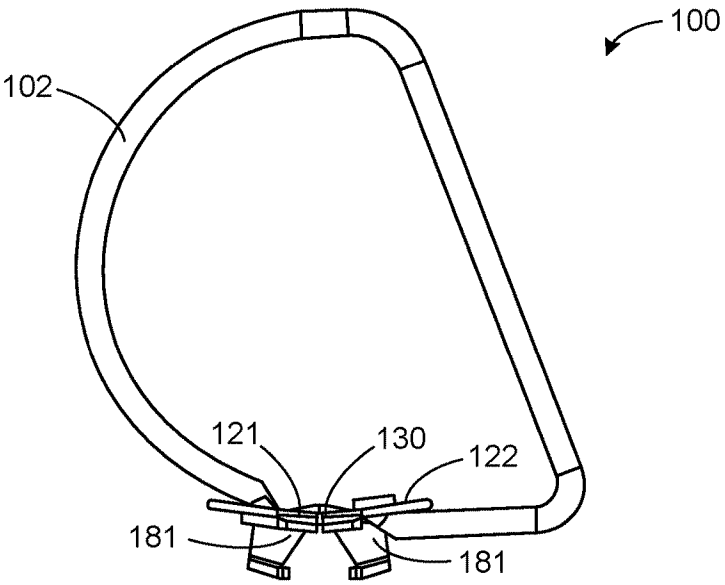
FIGS. 4A-4B depict a bottom perspective view and an end elevational view of the carrier rails of the binder apparatus of FIGS. 1A-1D in the closed position without an example slider and housing.
Figure 4A:
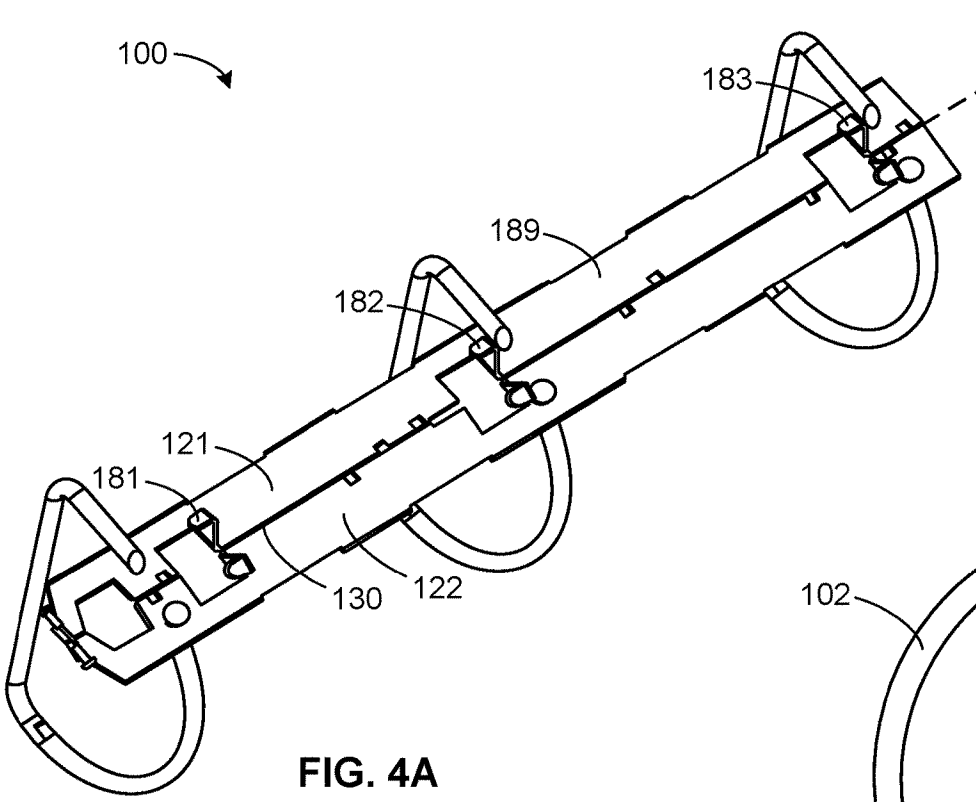

FIG. 4A-4B illustrate additional views of the example binder 100 with the slider 110 and the housing 101 removed. As shown in FIG. 4A, the longitudinal axis 130 extends between the carrier rails 121 and 122 and the tabs 181, 182, 183 extend from the carrier rails 121, 122. In some examples, the tabs 181, 182, 183 are stamped out of the carrier rails 121, 122. In other examples, the tabs 181, 182, 183 are coupled and/or welded to the carrier rails 121, 122. As shown in FIG. 4A-4B, the detents 181, 182, 183 extend from the surface 189 of the carrier rails 121, 122.

Figure 6A:
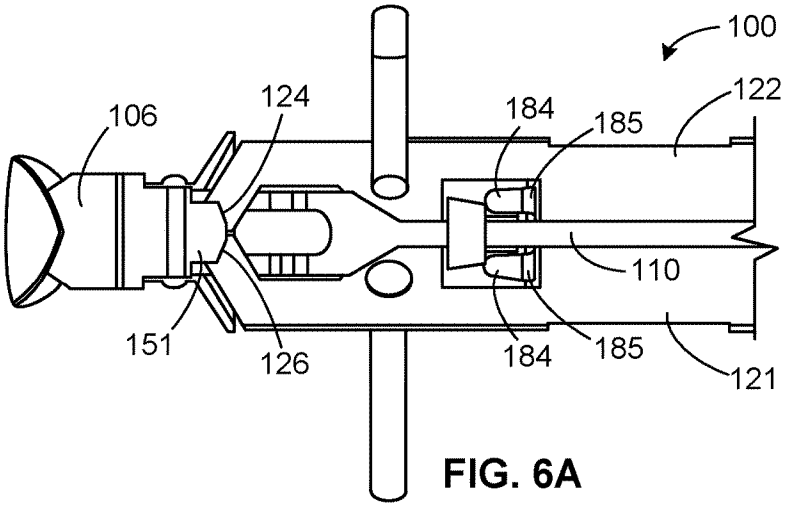
FIGS. 6A-6B depict a partial bottom view and a partial side elevational view of the binder apparatus of FIGS. 1A-1D in the open position without the housing.
Figure 5A:
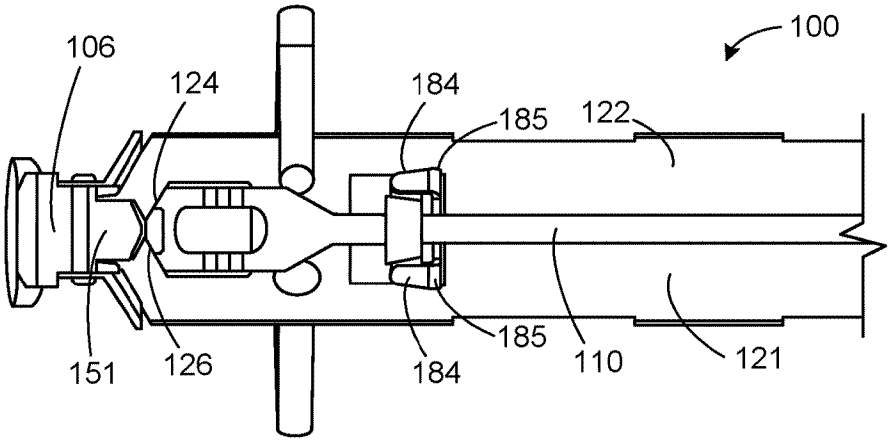
FIGS. 5A-5B depict a partial bottom view and a partial side elevational view of the binder apparatus of FIGS. 1A-1D in the closed position without the housing.
Figure 6B:
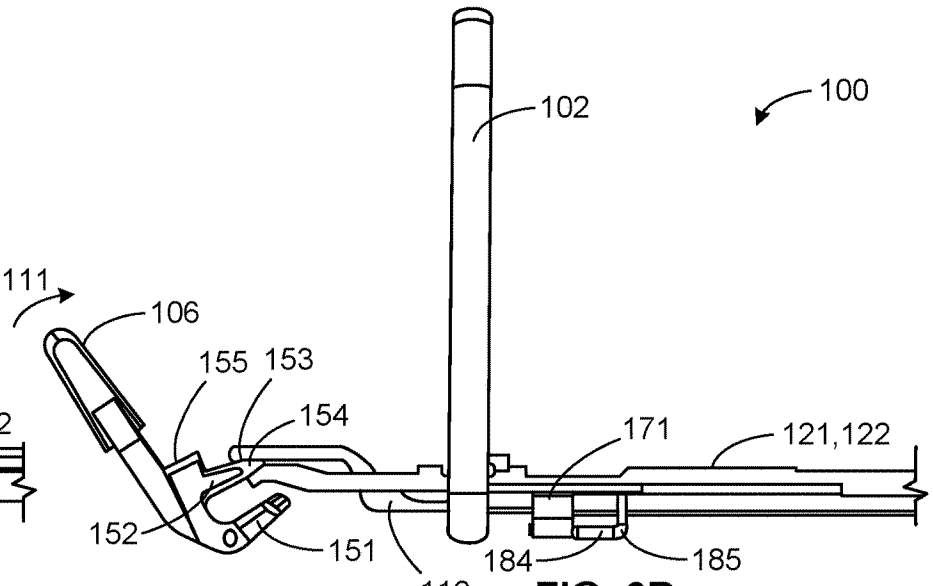
Figure 5B:
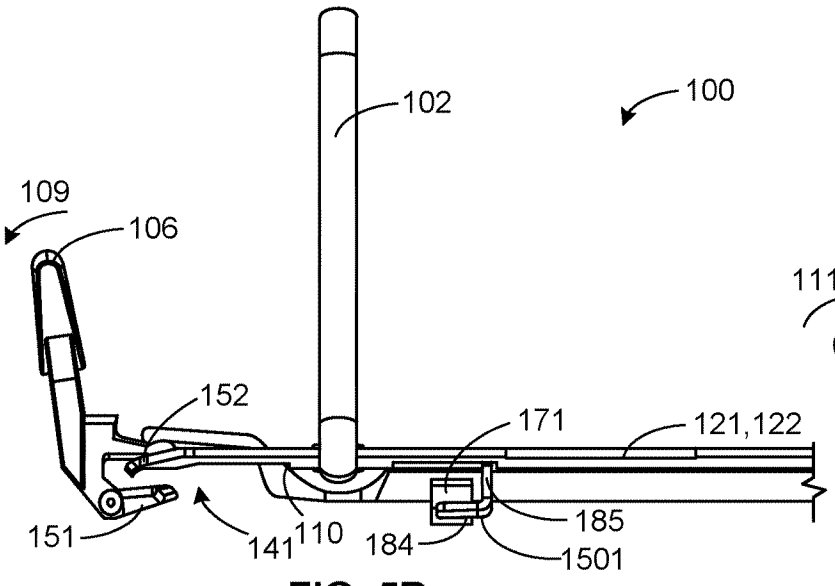

The illustrated examples of FIGS. 5A-5B show the lever 106 in a closed position, and the illustrated examples of FIGS. 6A-6B show the lever 106 in an opened position. In some examples, the lever 106 includes a lower beak 151 and an upper beak 152. As shown in FIG. 5B, when the lever 106 moves from the closed position to the open position in a direction generally indicated by arrow 109, the slider 110 moves in a direction generally represented by arrow 141 to position the slider 110 closer to the carrier rails 121 and 122 and the locking elements 171 away from being between the detents 182, 183. In some examples, when the lever 106 is pulled and/or moved in the direction generally represented by arrow 109 from the closed position to the opened position, the lower beak 151 pushes the inner edges 124 and 126 of the carrier rails 121 and 122 toward the second portion 114 of the housing 101, which causes the carrier rails 121 and 122 to pivot relative to the longitudinal axis 130 (see FIG. 1E) and move the closure members 102 toward an open position. As shown in FIG. 6A-6B, when the lever 106 is moved in a direction generally represented by arrow 111 from the opened position to the closed position, the upper beak 152 pushes the edges 124 and 126 of the carrier rails 121 and 122 away from the second portion 114 of the housing 101, which causes the carrier rails 121 and 122 to pivot relative to the longitudinal axis 130 shifting and moving the closure members 102 toward the closed position.

In some examples, as shown in FIGS. 5A-5B and 6A-6B, the detents and/or tabs and/or bent tabs 181, 182, 183 are stamped out from the carrier rails 121, 122 during a stamping operation such that the detents 181, 182, 183 include first and/or second foot portions 184 and first and/or second leg portions 185. In some examples, the leg portions 185 extend substantially perpendicularly from the surface 189 of the carrier rails 121, 122, and the foot portions 184 extend from the leg portions 185 such that the foot portion 184 are substantially parallel to the surface 189 of the carrier rails 121, 122. As used herein, the phrase "substantially perpendicular" means within about 10 degrees or less of perpendicular. As used herein, the phrase "substantially parallel" means within about 10 degrees or less of parallel. Detents 181, 182, 183 have similarly oriented foot and leg portions 184, 185. In some examples, when the slider 110 is in the closed position, the locking elements 171, 172, 173 are positioned between the foot portions 184 of the detents 181, 182, 183 to prevent the respective ends 1501 of the detents 181, 182, 183 from moving toward one another and opening the closure members 102. When the slider 110 is in the opened position, the locking elements 171, 172, 173 are positioned at a distance from and/or not between the foot portions 184 of the detents 181, 182, 183 to enable the respective ends 1501 of the detents 181, 182, 183 to move toward one another and open the closure members 102.

As shown in FIGS. 5B and 6B, in some examples, the upper beak 152 of the lever 106 has a groove, slot and/or arched-groove 153 that is sized and/or configured to receive a bar, bracket end and/or portion 175 of the slider 110. The groove 153 may be positioned in any suitable position on the lever 106. The groove 153 may have any suitable shape, contours and/or curvatures (e.g., curve(s), straight, arched, etc). The groove 153 may have an opening to enable the bar 175 to be received therein. In some examples, the bar 175 translates within the groove 153 as the lever 106 moves between the opened and/or closed positions. In some examples, the groove 153 has a first end 154 and a second end 155. In some examples, when the binder 100 is in an open position, the bar 175 of the slider 110 is positioned immediately adjacent the first end 154 of the groove 153. When the lever 106 is moved from the open position to the closed position in a direction generally indicated by arrow 111, the upper beak 152 moves toward the carrier rails 121, 122 and the bar 175 remains substantially stationary as the lever 106 moves toward the closed position, enabling the bar 175 to transition from the first end 154 of the groove 153 toward the second end 155 the groove 153. Therefore, as the carrier rails 121, 122 initially transition from the open position to the closed position, the slider 110 remains in the open position, non-blocking and/or second position. As the detents 181, 182, 183 are moved apart laterally, a space between the detents 181, 182, 183 increases until the space is greater than the width of the locking elements 171, 172, 173. Once the space between the detents 181, 182, 183 is greater than the width of the locking elements 171, 172, 173, the spring 131 (FIG. 2B) moves the slider 110 and the locking elements 171, 172, 173 into the closed position and moves the locking elements 171, 172, 173 in between the detents 181, 182, 183. Enabling a delay of the movement of the slider 110 and/or enabling the bar 175 to move within the groove 153 as the carrier rails 121, 122 initially translate from the open position to the closed position substantially prevents the binder 100 from jamming. The binder 100 may also transition from the open to closed position by actuating the closure members 102. In the closed position, the locking elements 171, 172, 173 may be positioned between the detents 181, 182, 183 to prevent the carrier rails 121, 122 from pivoting and/or the binder 100 from opening.

Figure 7B:
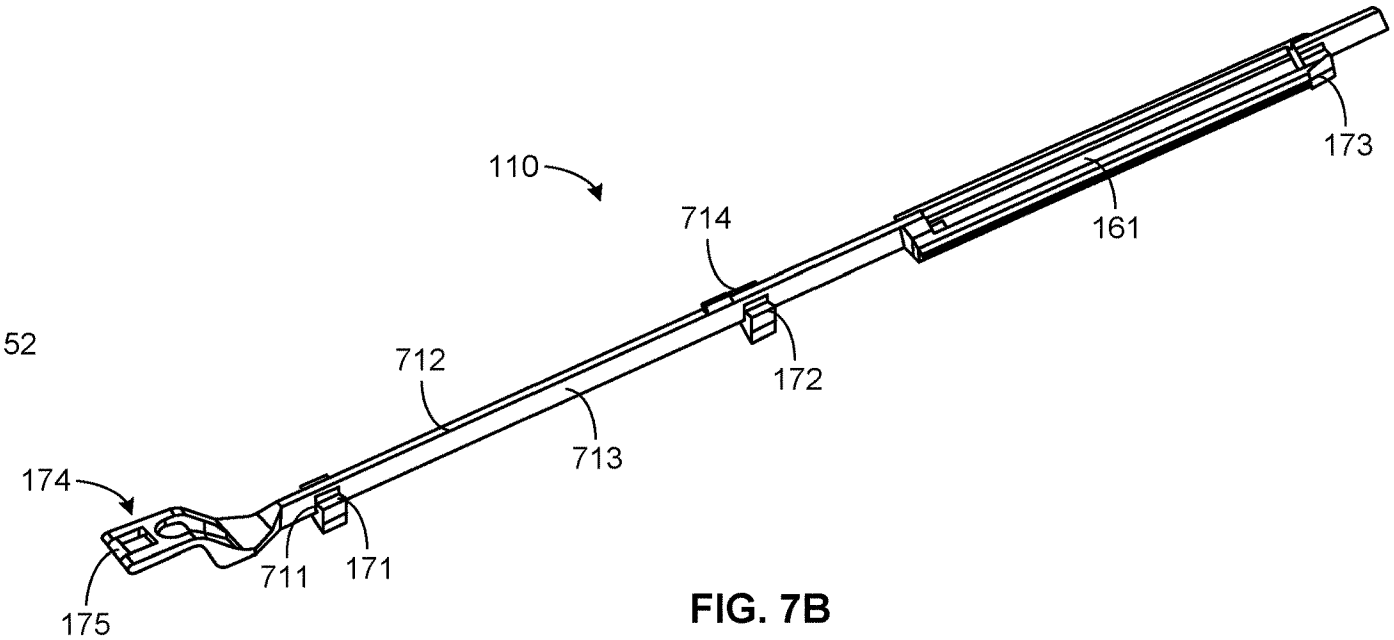
FIGS. 7A-7D depict a side elevational view of an example lever, a perspective view of the example slider, a partial top view of the slider, and a partial side elevational view of the slider of FIGS. 1A-1D.
Figure 7A:
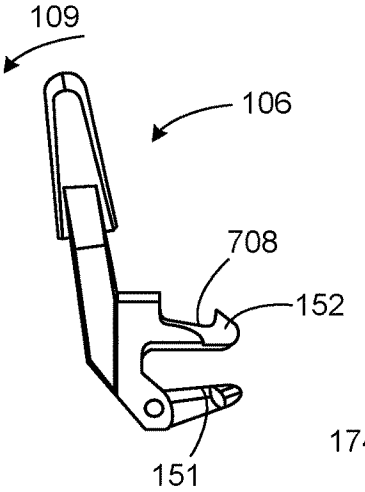
Figure 7D:
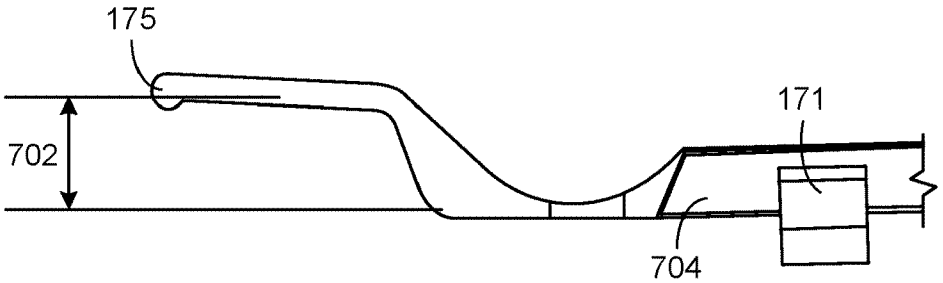
Figure 7C:
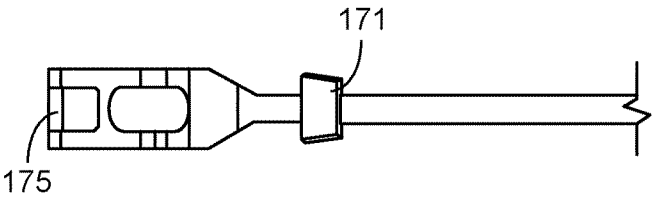

FIGS. 7A-7D show alternative views of the lever 106 and the slider 110 with the housing 101 and carrier rails 121, 122 removed. In some examples, the slider 110 includes the compartment 161 (see also FIGS. 2B, 3B) and the locking elements 171, 172 and 173. In some examples, the compartment 161 is a groove that extends along a longitudinal axis of the slider 110. As shown in a FIG. 7B, a surface 711 of the locking elements 171, 172, 173 is spaced apart from a surface 712 of the elongated body 713 of the slider 110. The surfaces 711, 712 both face interior surface of the housing 101. On some examples, the slider 110 includes a side 714 that is received by the carrier rails 121, 122 to at least partially guide the movement of the slider 110. In some examples, the third locking element 173 is at an end of the groove 161 and/or the second portion 504. In some examples, one or more of the locking elements 171, 172, 173 has a trapezoidal cross-section. As shown in FIG. 7B-7D, in some examples, the slider 110 has a first end 174 defining the bracket and/or portion 175 that connects with and/or is received in a groove 708 of the lever 106, such that when the lever 106 correspondingly moves the slider 110 toward the open and/or closed position. In some examples, the bracket 175 is spaced a distance 702 from an elongated portion 704 of the slider 110.

Figure 8A:
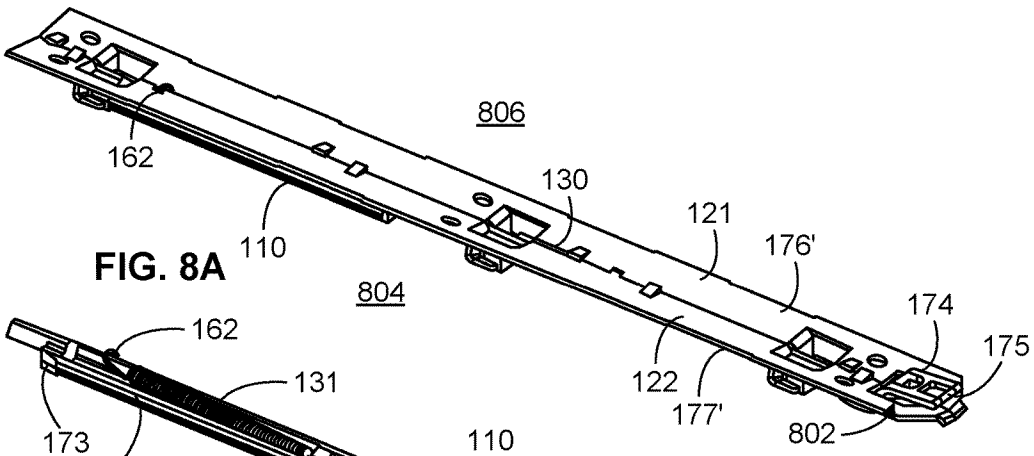
FIG. 8A depicts a perspective view of the carrier rails and the slider of the binder apparatus of FIGS. 1A-1D.
Figure 8B:
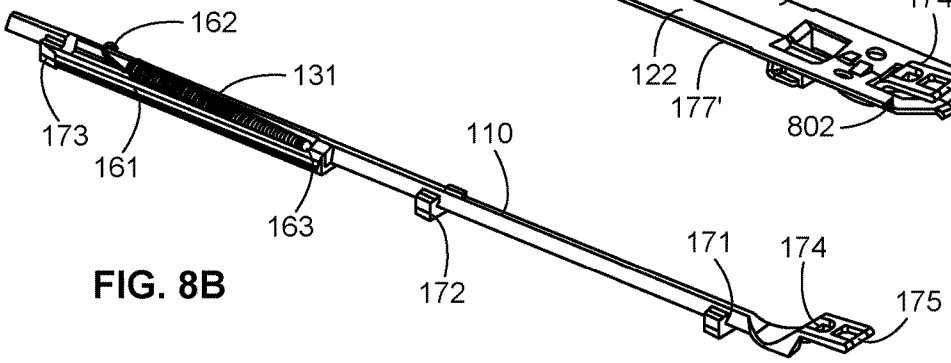
FIG. 8B depicts a perspective view of the slider and a spring of the binder apparatus of FIGS. 1A-1D.

FIGS. 8A and 8B show isometric perspective views of the carrier rails 121, 122, the slider 110 and the spring 131. As shown in FIG. 8A, the bracket 175 of the slider 110 extends through an aperture 802 defined by the carrier rails 121, 122 such that the elongated portion 704 is on a first side 804 of the carrier rails 121, 122 and the bracket 175 is on a second side 806 of the carrier rails 121, 122. For example, the bracket 175 is positioned adjacent an interior edge 176' of the carrier rails 121, 122, facing the housing 101. Additionally, in this example, the first end 162 of the spring 131 is connected to at least one of the carrier rails 121, 122. As shown in FIG. 8B, in the illustrated example, the spring 131 is positioned within the compartment 161 of the slider 110, and the second end 163 of the spring 131 is connected to the slider 110.

Figure 8F:
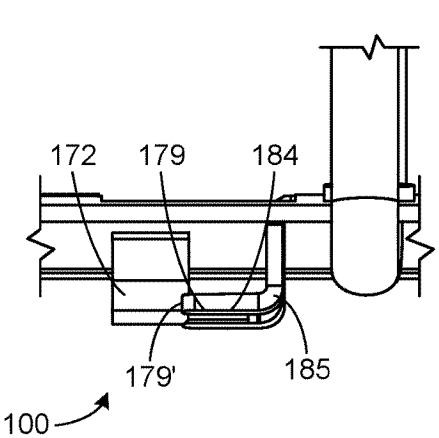
FIG. 8F depicts a partial elevational side view of the slider and carrier rails of the binder apparatus of FIGS. 1A-1D in the opened position.
Figure 8E:
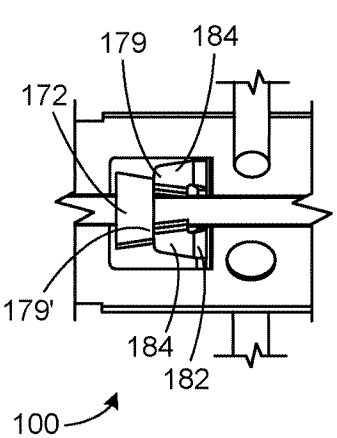
FIG. 8E depicts a partial bottom view of the slider and carrier rails of the binder apparatus of FIGS. 1A-1D in the opened position.
Figure 8D:
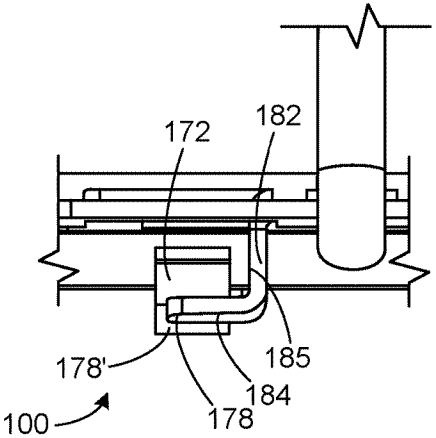
FIG. 8D depicts a partial side elevational view of the slider and carrier rails of the binder apparatus of FIGS. 1A-1D in the closed position.
Figure 8C:
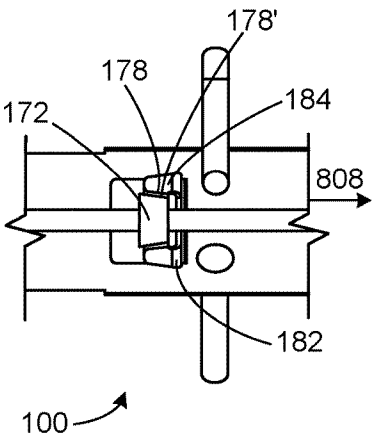
FIG. 8C depicts a partial bottom view of the slider and carrier rails of the binder apparatus of FIGS. 1A-1D in the closed position.

FIGS. 8C-8F show various partial views of the locking element 172, the detents 181, 182, 183, the detent feet 184, and the detent legs 185. FIG. 8C shows a partial bottom view of the binder 100 in the closed position with the locking element 172 positioned in between the feet 184 of the detent 182 and, thus, substantially preventing the carrier rails 121, 122 from transitioning to the open position. The feet 184 have inner lateral faces, surfaces, and/or edges 178 that are engaged with lateral faces 178' of the locking element 172. As shown in FIG. 8C, the lateral faces 178 of the feet 184 and the lateral faces 178' of the locking element 172 are tapered toward the axis 130 in the direction generally indicated by arrow 808, which enables the locking elements 172 to slide and wedge in between the feet 184 when the binder 100 moves toward a closed position. FIG. 8D shows a partial side view of the binder 100 in the closed position with the locking element 172 positioned in between the feet 184 of the detent 182, so that the lateral faces 178 of the feet 184 engage the lateral faces 178' of the locking element 172. FIG. 8E shows a partial bottom view of the binder 100 in the opened position with the locking element 172 positioned such that the locking element 172 is spaced apart from and/or not between the feet 184, thus, enabling the carrier rails 121, 122 to transition from the closed position to the open position. FIG. 8F shows a partial side view of the binder 100 in the opened position with the locking element 172 positioned such that the locking element 172 is spaced apart and/or not between the feet 184.

Figure 9A:
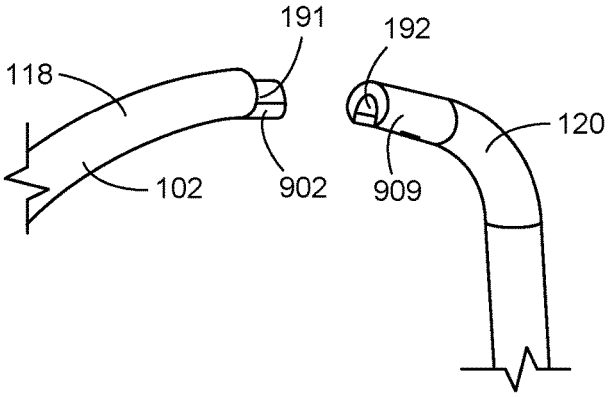
FIGS. 9A-9C depict various views of the closure members of the binder apparatus of FIGS. 1A-1D in the opened position.
Figure 9B:
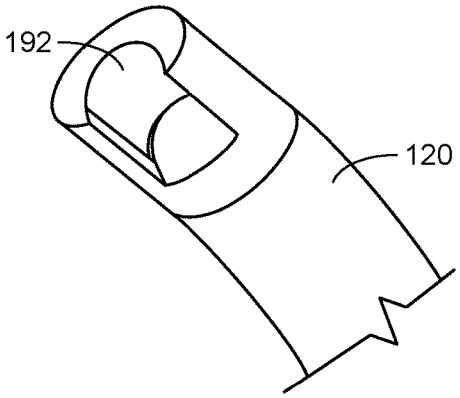
Figure 9C:
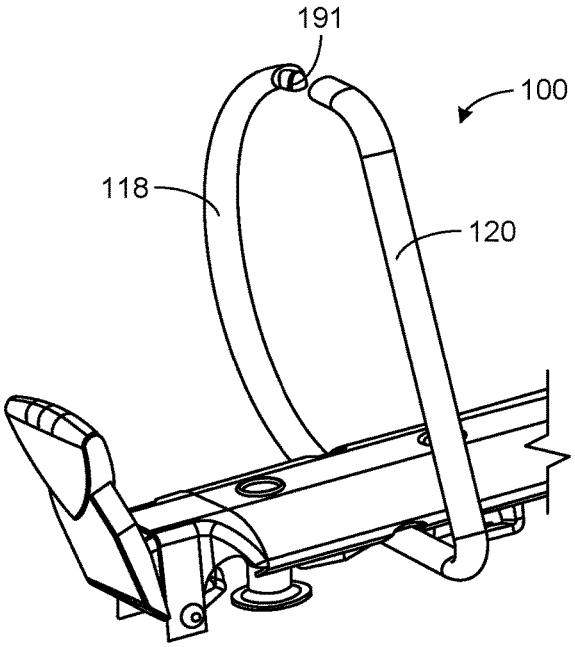
Figure 9D:
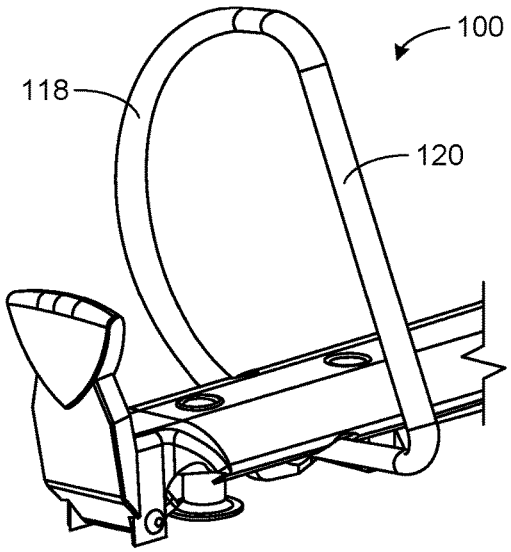
FIG. 9D depicts a perspective view of the closure members of the binder apparatus of FIGS. 1A-1D in the closed position.

FIGS. 9A-9C show multiple views of the closure member 102. Each of the closure members 102 includes the first and second portions 118 and 120. In some examples, one of the first or second portions 118, 120 has a knob and/or male portion 191 and the other of the first or second portions 120 has a groove, receptor and/or female portion 192. The male portion 191 is shaped and sized such that it aligns, fits within and/or is received by the female portion 192 in a locking position, thereby securing the first and second portions 118 and 120 of the closure member 102 together. FIG. 9D shows the first and second portions 118 and 120 in a closed configuration. As the closure members 102 move from the closed position to the open position, a bottom surface 902 of the male portion 191 is positioned within and substantially flush with a surface 909 of the female portion 192, thereby substantially preventing a step from forming where paper could snag or tear.

Figure 10A:
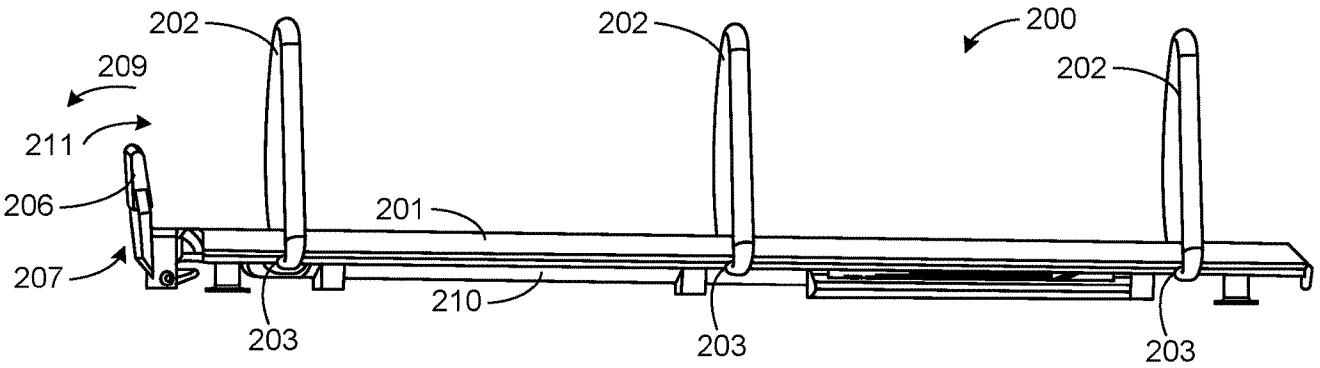
FIGS. 10A-10D depict a partial side elevational view, a top view, an end elevational view, and a perspective bottom view of another example binder apparatus in a closed position.
Figure 10B:
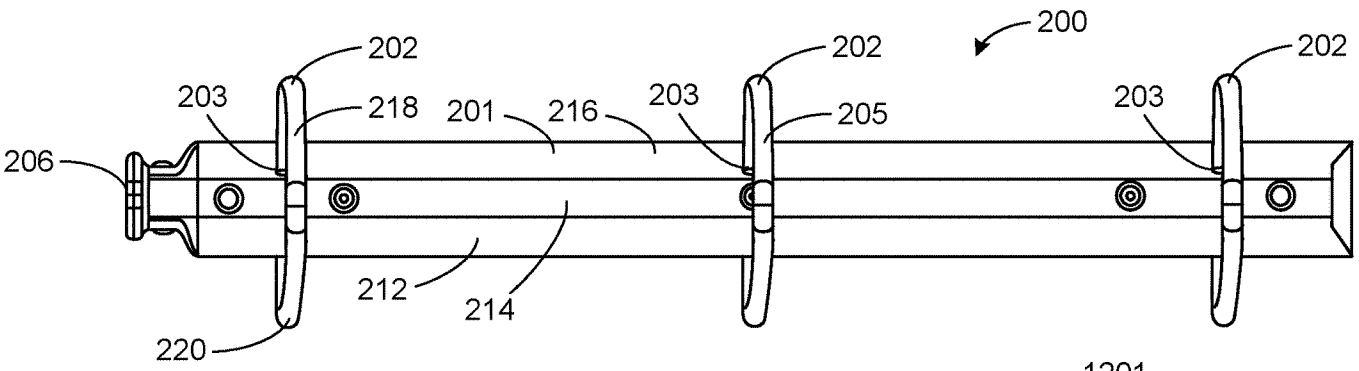

FIGS. 10A, 10B, 10C, and 10D show another example binder apparatus 200 that may be used to store loose leaf pages, documents, other materials, etc. In this example, the binder 200 includes a housing 201, one or more closure members 202 extending through openings 203 in the housing 201 and a slider 210. The closure members 202 cooperate pairwise to form at least one ring 205 (FIG. 10B). The binder 200 also includes a lever or actuating assembly 207 that may be actuated to open and close the closure members 202. Specifically, to open the closure members 202, a lever 206 of the lever assembly 207 is moved in a direction generally represented by arrow 209 and, to close the closure members 202, the lever 206 is moved in a direction generally represented by arrow 211. However, the lever assembly 207 may be differently configured to open and/or close the closure members 202.

Figure 10C:
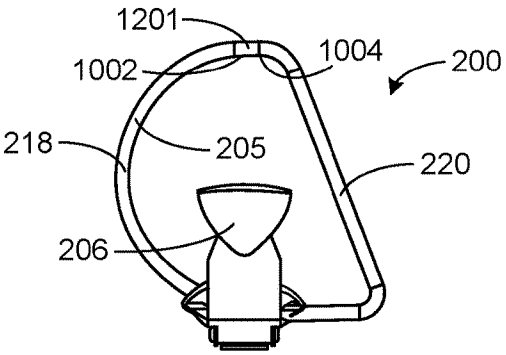
Figure 12C:
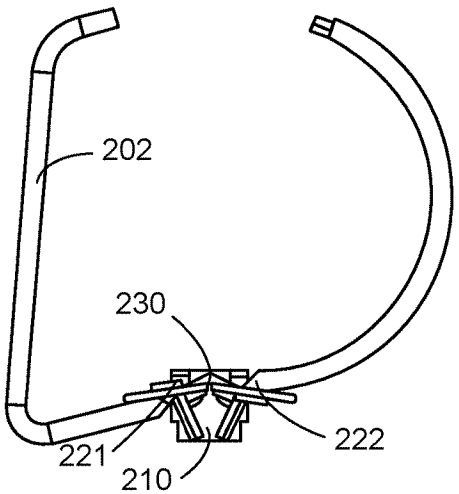

The housing 201 includes a first side or portion 212, a second side or portion 214, and a third side or portion 216. The second side 214 is coupled to and positioned between the first side 212 and the third side 216. As shown in FIG. 10C, each of the closure members 202 includes a first portion or section 218 and a second portion or section 220. The first and second portions 218 and 220 engage and/or interact to form respective rings 205 that enable documents, papers, etc. to be stored within the binder 200. In the illustrated example, the second portion 220 defines a groove 1201 (FIG. 12C) that receives an end of the first portion 218 such that a surface 1002 of the first portion 218 is substantially flush and/or in-line with a surface 1004 of the second portion 220 even as the portions 218, 220 move toward the open position. Thus, a step may not be created between the portions 218, 220 where paper may catch or snag. In some examples, the closure members 202 may be different than shown in FIGS. 10A-10C. For example, the first and/or second portions 218 and 220 may be differently curved, may have different ends, both be similar to one another, may form a ring or any closed shape, etc.

Figures 10D, 10E:
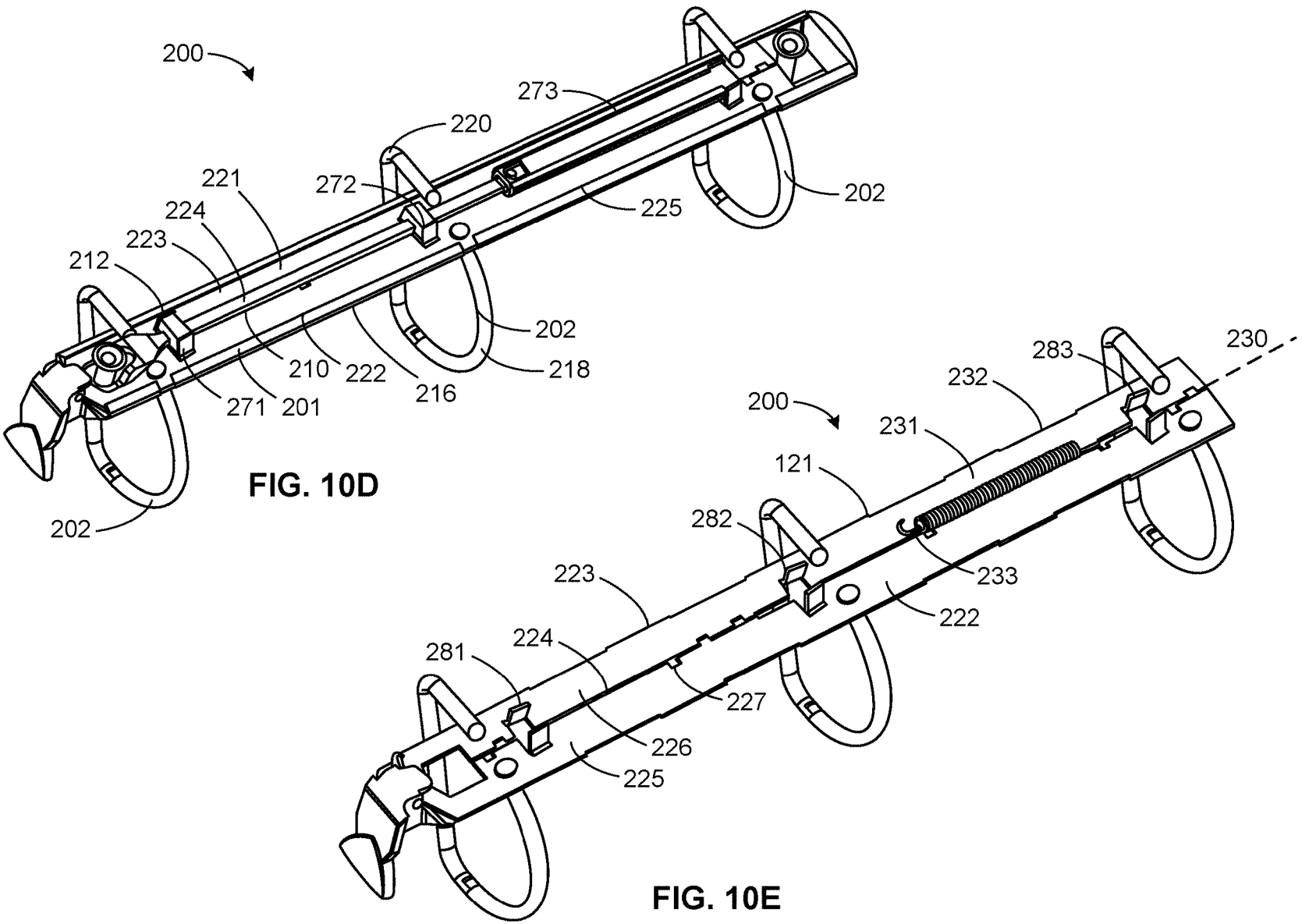
FIG. 10E depicts a perspective bottom view of the binder apparatus of FIGS. 10A-10D in the closed position without the housing.

FIGS. 10D and 10E show alternative views of the example binder 200, where FIG. 10D shows a bottom perspective of the example binder 200 with the housing 201 and the slider 210 and FIG. 10E shows a bottom perspective of the example binder 200 with the housing 201 and slider 210 removed for illustrative purposes. The housing first and third sides 212 and 216 may have a cross sectional shape forming housing flanks (e.g., curved edges) to at least partially retain carrier rails 221 and 222 in the housing 201. The closure members 202 are respectively coupled to the carrier rails 221, 222. The first carrier rail 221 includes a first longitudinal edge 223 biased by the first side 212 of the housing 201 and a second longitudinal edge 224 that includes a plurality of notches or engaging pieces 227. The second carrier rail 222 includes a third longitudinal edge 225 biased by the third side 216 of the housing 201 and a fourth longitudinal edge 226 that includes a plurality of notches or engaging pieces 227. In some examples, one or neither of the first or second carrier rails 221 and 222 include the notches or engaging pieces 227. The second longitudinal edge 224 and the fourth longitudinal edge 226 may be hingably coupled via the plurality of corresponding notches or engaging pieces 227, for example.

Figures 11A, 12A:
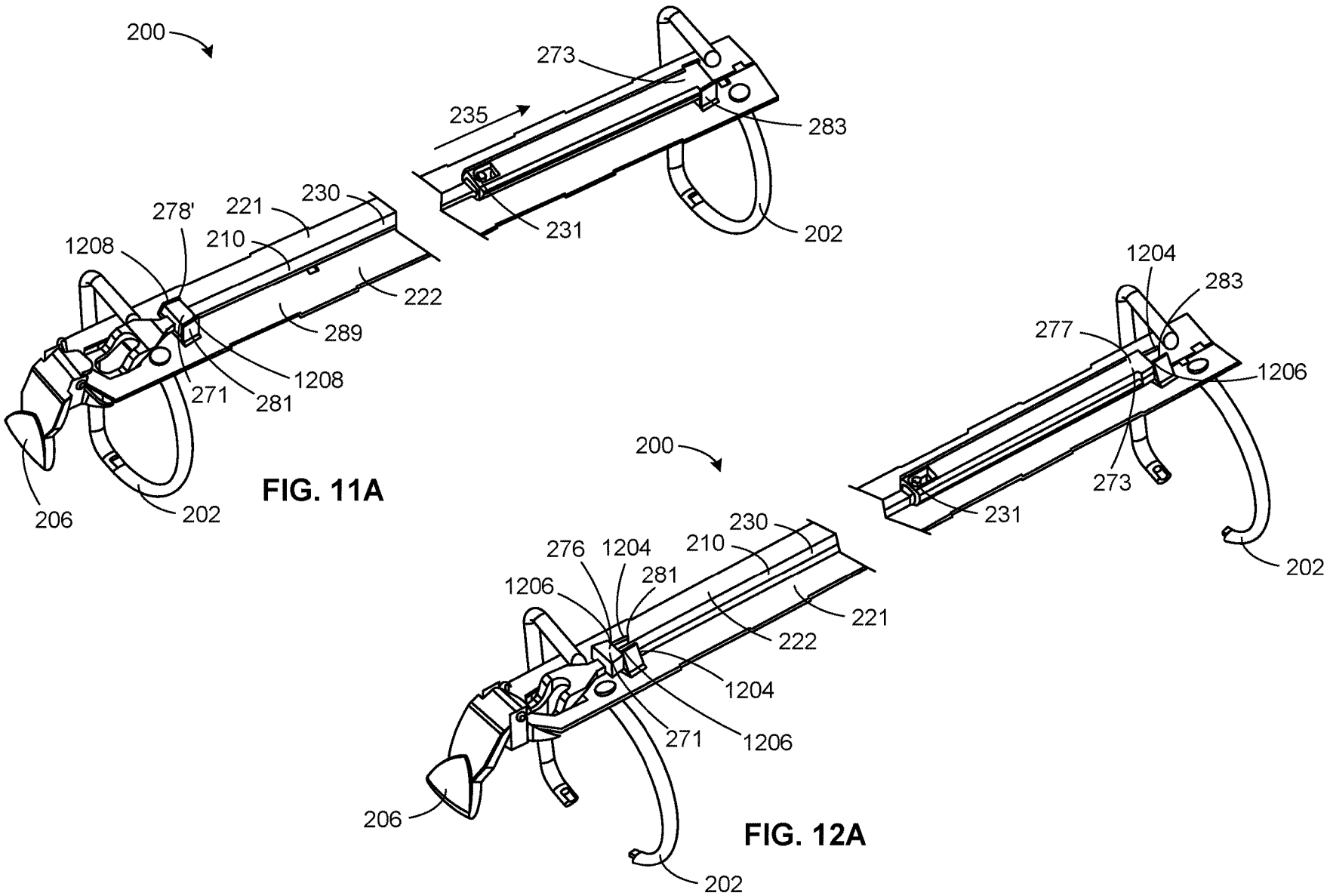
FIGS. 11A-11C depict a perspective bottom view, a side elevational view and an end elevational view of the binder apparatus of FIGS. 10A-10D in the closed position without the housing.
FIGS. 12A-12C depict a perspective bottom view, a side elevational view and an end elevational view of the binder apparatus of FIGS. 10A-10D in the open position without the housing.

FIGS. 11A and 12A show bottom views of partial sections of the binder 200 without the housing 201. FIG. 11A shows the binder 200 in a closed position. FIG. 12A shows the binder 200 in an open position. As shown in FIG. 11A, the carrier rails 221, 222 include tabs and/or detents 281, 282, 283 that extend substantially perpendicularly from a surface and/or face 289 of the carrier rails 221, 222. In some examples, the tabs 281, 282 283 include inwardly tapering surfaces 1208 such that a distance between first ends 1204 of tabs 281, 282, 283 are closer and/or less than a distance between second ends 1206 of the tabs 281, 282, 283.

To secure the binder 200 in the closed position, the detents 281, 283 are engaged by lateral faces, surfaces, and/or edges 278' of locking blocks and/or elements 271, 272, 273 of the slider 210 such that the locking blocks 271, 272, 273 are positioned between the detents 281, 282, 283 and prevent the ends 1201, 1202 of the detents 281, 282, 283 from moving toward each other and, in turn, opening the closure members 202. In some examples, when the locking blocks 271, 272, 273 are positioned between the detents 281, 282, 283, a majority and/or a substantial portion of the tapered surfaces 278' engage the inward tapered facing surfaces 1208 of the detents 281, 282, 283. Such engagement between the surfaces 1208, 278' may increase the locking force between the locking blocks 271, 272, 273 and the detents 281, 282, 283, thereby substantially ensuring the closure members 202 of the binder 200 do not inadvertently open. As shown in FIG. 12A, to enable the binder 200 to be in and/or move toward the open position, the locking blocks 271, 273 are spaced from being between the detents 281, 282, 283 to enable the ends 1201, 1202 of the detents 281, 283 to move toward each other and, in turn, open the closure members 202.

As shown in FIG. 11A, a spring 231 is connected to the slider 210 and at least one carrier rail 221, 222 and/or the housing 201. The spring 231 provides a pulling force in a direction generally indicated by arrow 235 that urges the slider 210 to move toward the closed position when the slider 210 is in the open position and/or not in the closed position.

Figure 11C:
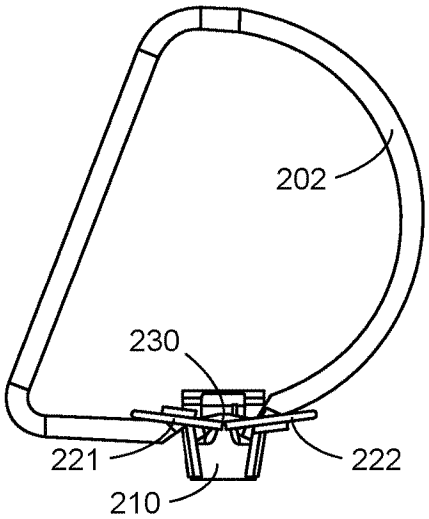
Figure 11B:
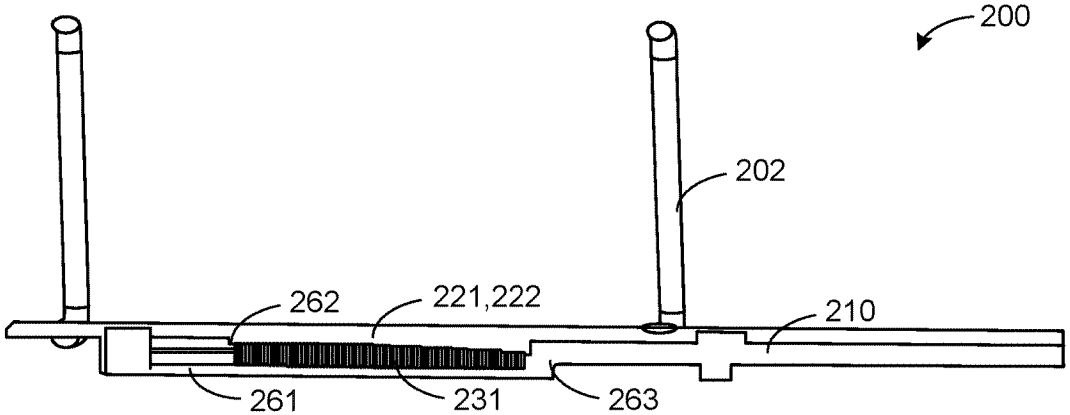
Figure 12B:
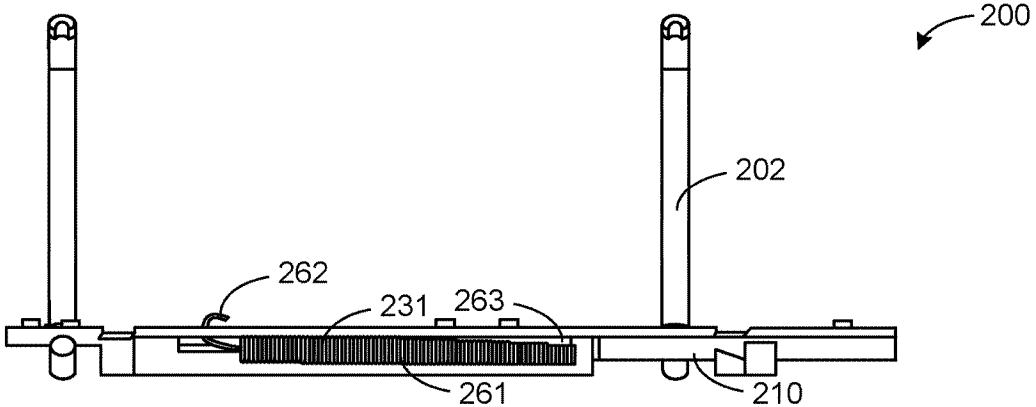

FIGS. 11B and 12B show cross-sectional side views of the binder 200 in closed and opened configurations and/or positions. In some examples, the spring 231 is at least partially positioned within a compartment, housing and/or groove 261 defined by the slider 210. In some examples, positioning the spring 231 within the groove 261 substantially aligns axes of the spring 231 and the slider 210, substantially prevents the slider 210 and/or the spring 231 from interfering with each other, etc. In some examples, a first end 262 of the spring 231 is connected to at least one of the carrier rails 221, 222, and a second end 263 of the spring 231 is connected to the slider 210. In other examples, the first end 262 can be coupled to the housing 201. As shown in FIG. 11B, when the binder 200 is in a closed configuration, the spring 231 is in a first position. As shown in FIG. 12B, when the binder 200 is in an opened configuration, the spring 231 is in a second position.

FIG. 11C shows an end view of the closure members 202, the carrier rails 221, 222 and the slider 210. When the carrier rails 221, 222 are displaced and/or pivoted about a pivot and/or longitudinal axis 230, the closure members 202 are actuated between the closed and opened positions.

Figure 12D:
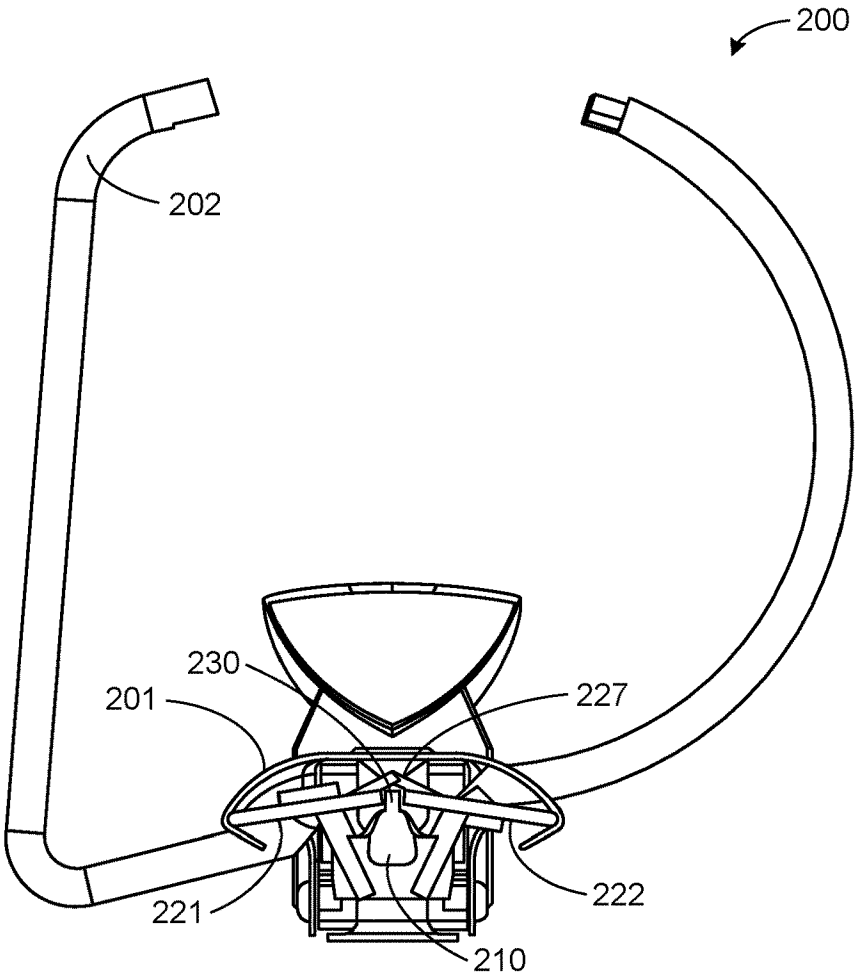
FIG. 12D depicts an enlarged end elevational view, partially in section, of the binder apparatus of FIGS. 10A-10D in the open position.
Figure 11D:
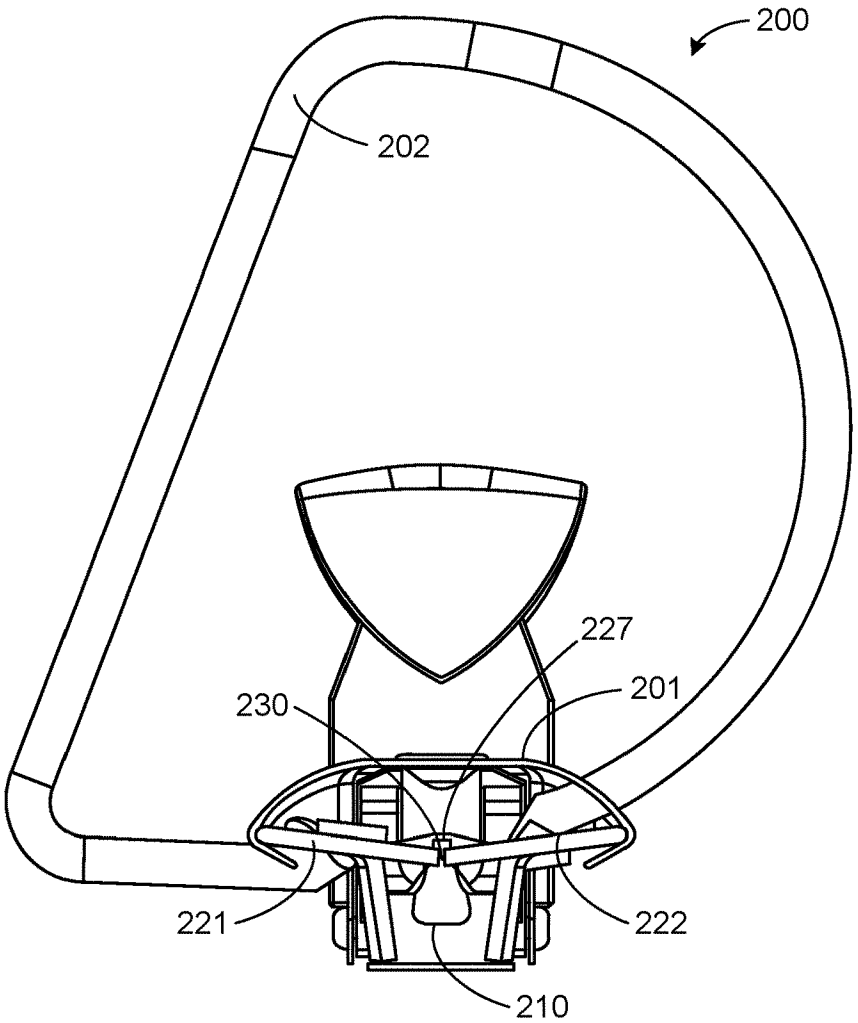
FIG. 11D depicts an enlarged end elevational view, partially in section, of the binder apparatus of FIGS. 10A-10D in the closed position.

FIGS. 11D and 12D show an end view of the binder 200 in closed and opened configurations with the housing 201, the carrier rails 221, 222, and the closure members 202. In both the opened and closed positions shown in FIGS. 11D and 12D, the carrier rails 221, 222 are hingably coupled about the longitudinal axis 230 via the plurality of corresponding notches or engaging elements 227.

Figure 13A:
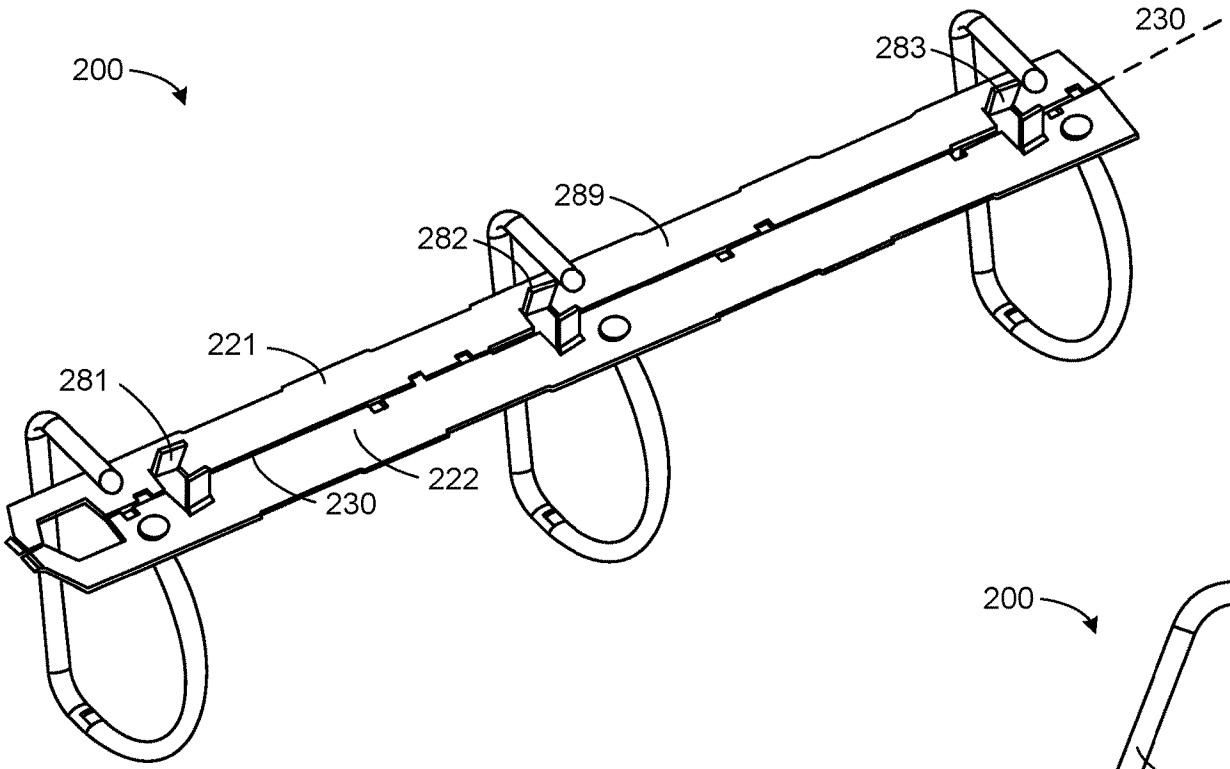
FIGS. 13A-13B depict a bottom perspective view and an end elevational view of the carrier rails of the binder apparatus of FIGS. 10A-10D in the closed position without the slider and housing.
Figure 13B:
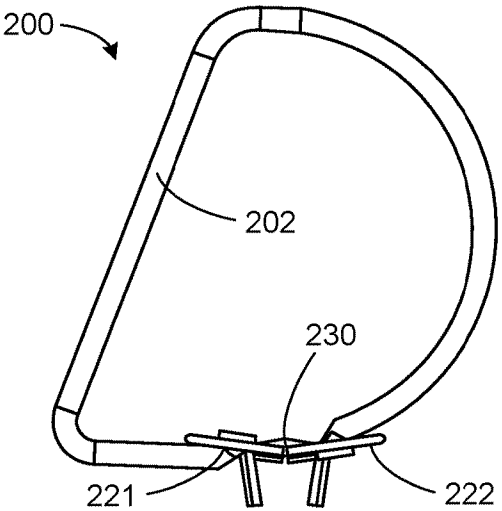

FIGS. 13A and 13B illustrate additional views of the example binder 200 with the slider 210 and the housing 201 removed. As shown in FIG. 13A, the longitudinal axis 230 extends between the carrier rails 221 and 222 and the tabs 281, 282, 283 extend from the carrier rails 221, 222. In some examples, the tabs 281, 282, 283 are stamped out of the carrier rails 221, 222. In other examples, the tabs 281, 282, 283 are coupled and/or welded to the carrier rails 221, 222. As shown in FIG. 13B, the detents 281, 282, 283 extend from the surface 289 of the carrier rails 221, 222.

Figure 15A:
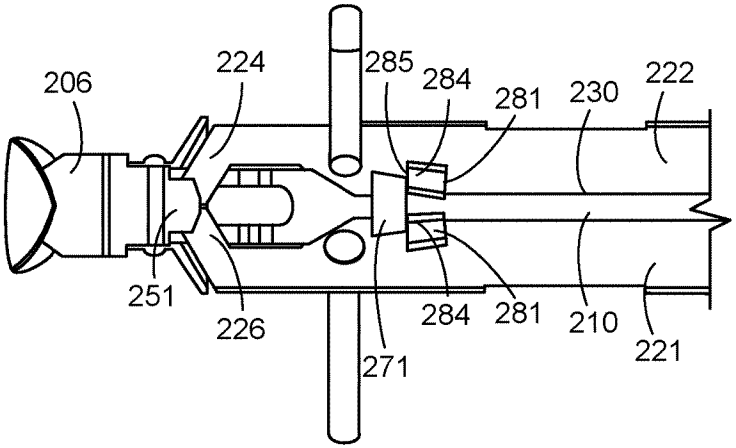
FIGS. 15A-15B depict a partial bottom view and a partial side elevational view of the binder apparatus of FIGS. 10A-10D in the open position without the housing.
Figure 15B:
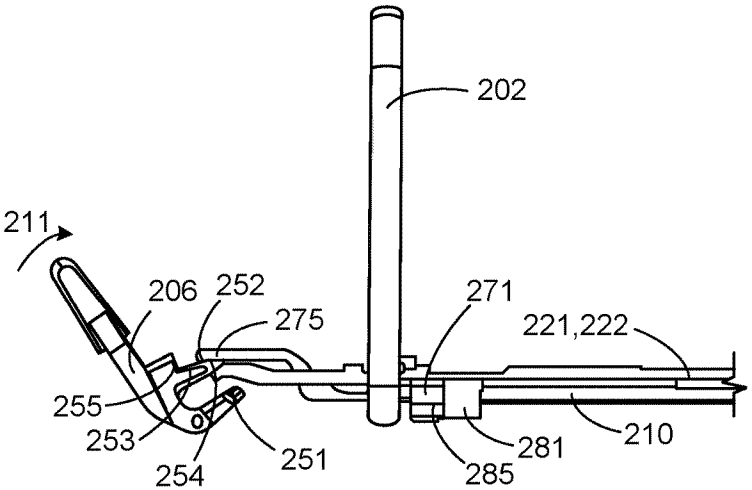
Figure 14A:
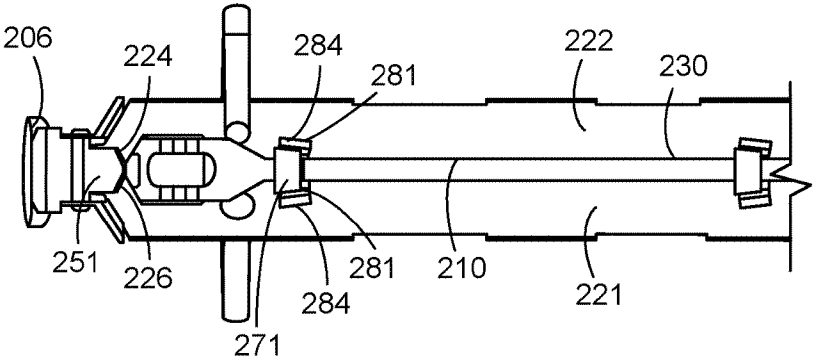
FIGS. 14A-14B depict a partial bottom view and a partial side elevational view of the binder apparatus of FIGS. 10A-10D in the closed position without the housing.
Figure 14B:
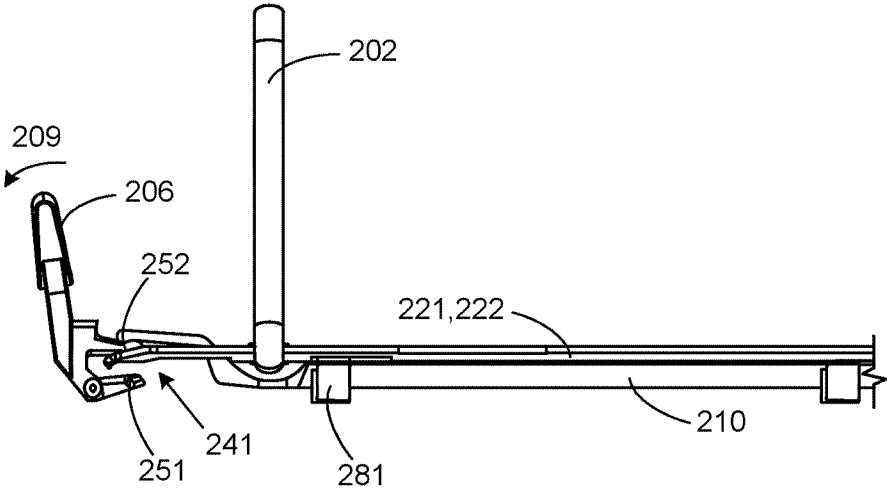

The illustrated example of FIGS. 14A-14B show the lever 206 in a closed position, and the illustrated examples of FIGS. 15A-15B show the lever 206 in an opened position. In some examples, the lever 206 includes a lower beak 251 and an upper beak 252. As shown in FIG. 14B, when the lever 206 moves from the closed position to the open position in a direction generally indicated by arrow 209, the slider 210 moves in a direction generally represented by arrow 241 to position the slider 210 closer to the carrier rails 221 and 222 and the locking elements 271, 273 away from the detents 282, 283. In some examples, when the lever 206 is pulled and/or moved in the direction generally represented by arrow 209 from the closed position to the opened position, the lower beak 251 pushes the inner faces 224 and 226 of the carrier rails 221 and 222 toward the second portion 214 of the housing 201, which pivots the carrier rails 221 and 222 relative to the longitudinal axis 230 (see FIG. 10E), and moves the closure members 202 toward an open position. As shown in FIG. 15A-15B, when the lever 206 is pushed in a direction generally indicated by arrow 211 from the opened position to the closed position, the upper beak 252 moved the inner faces 224 and 226 of the carrier rails 221 and 222 away from the second portion 214 of the housing 201, which causes the carrier rails 221 and 222 to pivot relative to the longitudinal axis 230, and move the closure members 202 toward the closed position.

In some examples, as shown in FIGS. 14A-14B and 15A-15B, the detents and/or tabs 281 are stamped out from the carrier rails 222, 221 during a stamping operation such that the exterior faces 284 of the detents 281 are tapered toward the longitudinal axis 230 in the direction generally indicated by arrow 235. In some examples, the detents 281 extend substantially perpendicularly from the surface 289 of the carrier rails 221, 222. As used herein, the phrase "substantially perpendicular" means within about 10 degrees or less of perpendicular. When the slider 210 is in the closed position, the locking element 271 is positioned between the detents 281. In some examples, when the slider 210 is in the opened position, the locking elements 271, 272, 273 are positioned at a distance from and/or not between longitudinal faces 285 of the detents 281, 282, 283.

As shown in FIGS. 14B and 15B, in some examples, the upper beak 252 of the lever 206 has a groove, slot and/or arched-groove 253 that is sized and/or configured to receive a bar, bracket end and/or portion 275 of the slider 210. In some examples, the bar 275 translates within the groove 253 as the lever 206 moves between the opened and/or closed positions. In some examples, the groove 253 has a first end 254 and a second end 255. In some examples, when the binder 200 is in an open position, the bar 275 of the slider 210 is positioned immediately adjacent the first end 254 of the groove 253. When the lever 206 is moved from the open position to the closed position in a direction generally indicated by arrow 211, the upper beak 252 moves toward the carrier rails 221, 222 and the bar 275 remains substantially stationary as the lever 206 moves, toward the closed position, enabling the bar 275 to transition from the first end 254 of the groove 253 toward the second end 255 the groove 253. Therefore, as the carrier rails 221, 222 initially transition from the open position to the closed position, the slider 210 remains in the open position, non-blocking and/or second position. As the detents 281, 282, 283 are moved apart laterally, a space between the detents 281, 282, 283 increases until the space is greater than the width of the locking elements 271, 272, 273. Once the space between the detents 281, 282, 283 is greater than the width of the locking elements 271, 272, 273, the spring 231 (FIG. 11B) moves the slider 210 and the locking elements 271, 272, 273 into the closed position and moves the locking elements 271, 272, 273 in between the detents 281, 282, 283. Enabling a delay of the movement of the slider 210 and/or enabling the bar 275 to move within the groove 253 as the carrier rails 221, 222 initially translate from the open position to the closed position substantially prevents the binder 200 from jamming. The binder 200 may also transition from the open to closed position by actuating the closure members 202. In the closed position, the locking elements 271, 272, 273 may be positioned between the detents 281, 282, 283 to prevent the carrier rails 221, 222 from pivoting and/or the binder 200 from opening.

Figure 16B:
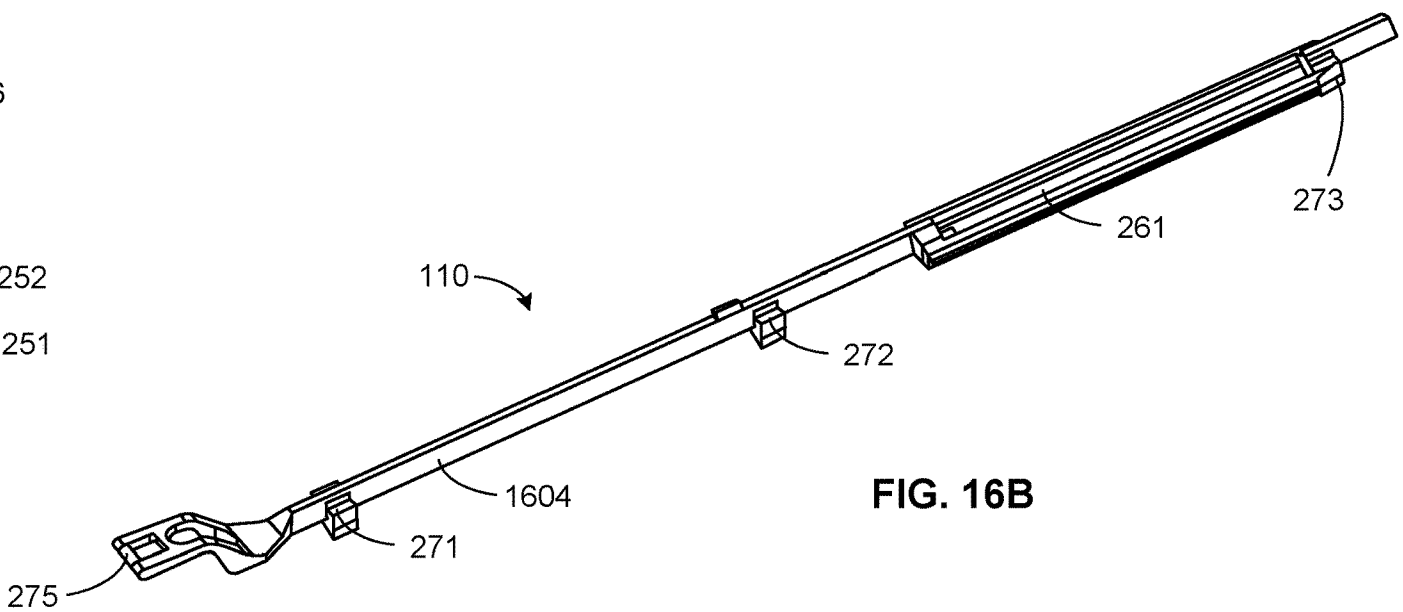
FIGS. 16A-16D depict a side elevational view of an example lever, a perspective view of the example slider, a partial top view of the slider, and a partial side elevational view of the slider of the binder apparatus of FIGS. 10A-10D.
Figure 16A:
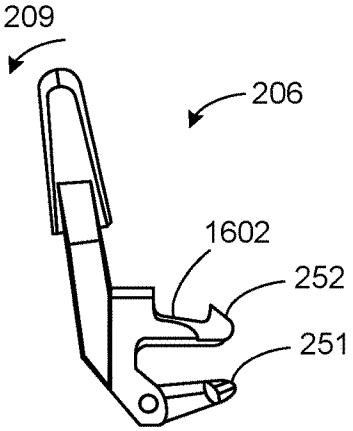
Figure 16D:
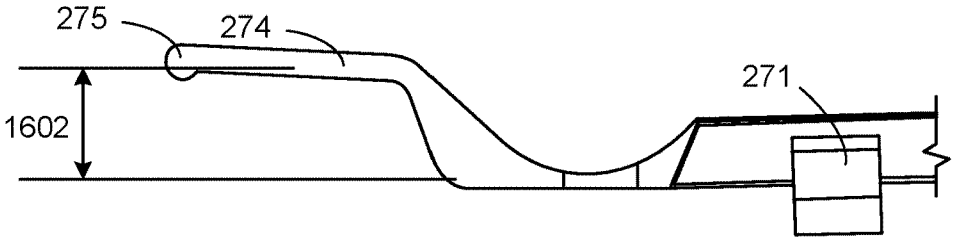
Figure 16C:
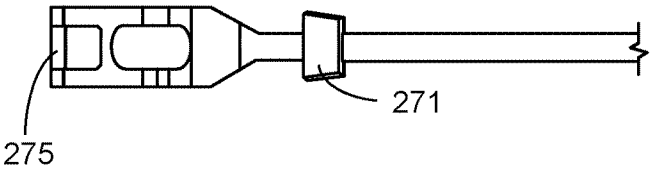

FIGS. 16A-16D show alternative views of the lever 206 and the slider 210 with the housing 201 and the carrier rails 221, 222 removed. In some examples, the slider 210 includes the compartment 261 (see also FIGS. 11B, 12B) and the locking elements 271, 272 and 273. In some examples, the third locking element 183 is at an end of the groove 261. In some examples, one or more of the locking elements 171, 172, 173 has a trapezoidal cross-section. As shown in FIG. 16B-16D, in some examples, the slider 210 has a first end 274 defining a bracket and/or portion 275 that connects with and/or is received in a groove 1602 of the lever 206, such that when the lever 206 moves, the slider 210 moves toward the open and/or closed position. Thus, in some examples, the slider 210 is directly coupled to the lever assembly 207 without an intermediate connector. In some examples, the bracket 275 is spaced a distance 1602 from an elongated portion 1604 of the slider 210.

Figure 17A:
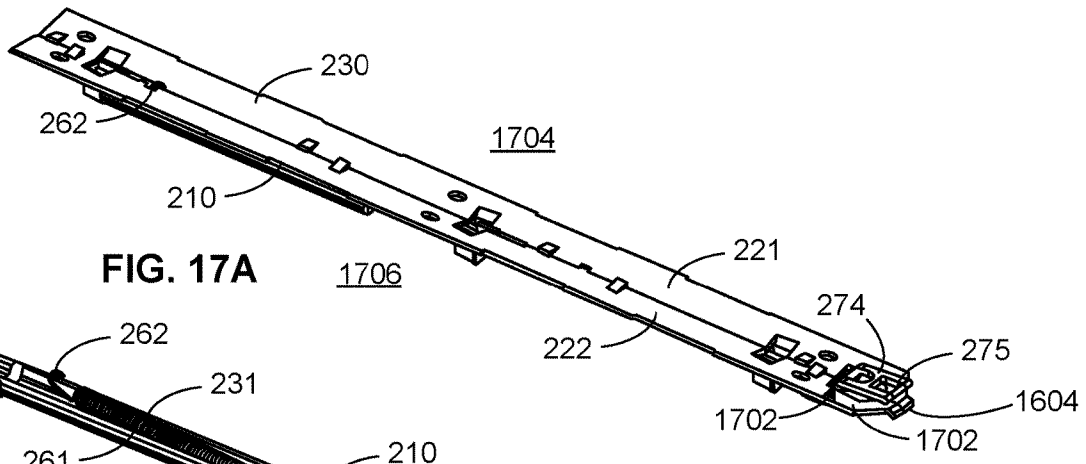
FIG. 17A depicts a perspective view of the carrier rails and the slider of the binder apparatus of FIGS. 10A-10D.
Figure 17B:
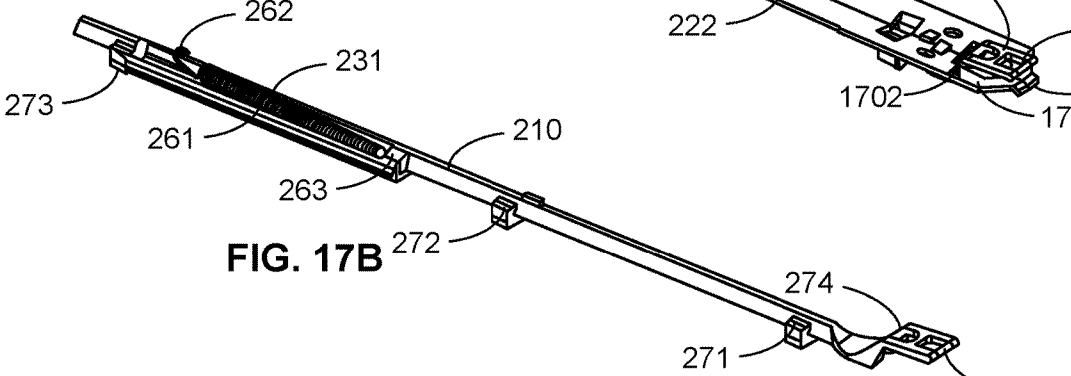
FIG. 17B depicts a perspective view of the slider and a spring element of the binder apparatus of FIGS. 10A-10D.

FIGS. 17A and 17B show isometric perspective views of the carrier rails 221, 222, the slider 210 and the spring 231. As shown in FIG. 17A, the bracket 275 of the slider 210 extends through an aperture 1702 defined by the carrier rails 221, 222 such that the elongated portion 1604 is on a first side 1704 of the carrier rails 221, 222 and the bracket 275 is on a second side 1706 of the carrier rails 221, 222. For example, the bracket 275 is adjacent the first side 1704 of the carrier rails 221, 222, facing the interior of the housing 201. Additionally, in this example, the first end 262 of the spring 231 is connected to at least one of the carrier rails 221, 222. As shown in FIG. 17B, in the illustrated example, the spring 231 is positioned within the compartment 261 of the slider 210, the first end 262 of the spring 231 is connected to one or both of the carrier rails 221, 222 and/or the housing 201, and the second end 263 of the spring 231 is connected to the slider 210.

Figure 17F:
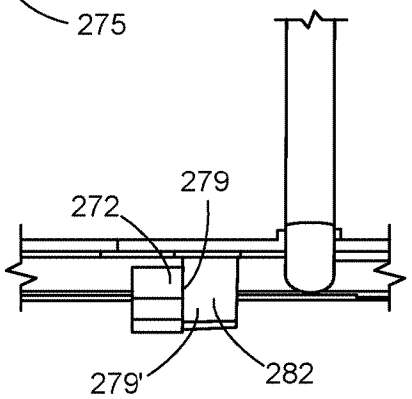
FIG. 17F depicts a partial side elevational view of the slider and the carrier rails of the binder apparatus of FIGS. 10A-10D in the opened position.
Figure 17E:
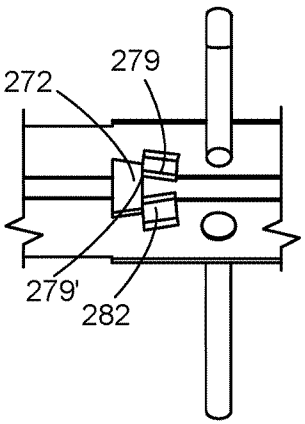
FIG. 17E depicts a partial bottom view of the slider and the carrier rails of the binder apparatus of FIGS. 10A-10D in the opened position.
Figure 17D:
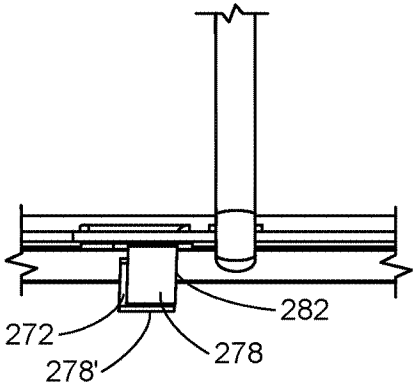
FIG. 17D depicts a partial side elevational view of the slider and the carrier rails of the binder apparatus of FIGS. 10A-10D in the closed position.
Figure 17C:
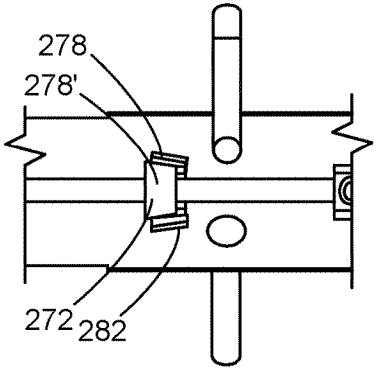
FIG. 17C depicts a partial bottom view of the carrier rails and the slider of the binder apparatus of FIGS. 10A-10D in the closed position.

FIGS. 17C-17F show various partial views of the locking element 272, the detents 282, and the detent exterior faces 284. FIG. 17C shows a partial bottom view of the binder 200 in the closed position with the locking element 272 positioned in between the detent exterior faces 284 of the detents 282 and, thus, substantially preventing the carrier rails 221, 222 from transitioning to the open position. The detents 281, 282, 283 have inner lateral faces 278 that are engaged with the lateral faces 278' of the locking elements 271, 272, 273. As shown in FIG. 17C, the lateral faces, surfaces, and/or edges 278 of the detents 281, 282, 283 and the lateral faces, surfaces, and/or edges 278' of the locking elements 271, 272, 273 are tapered, which enable the locking elements 271, 272, 273 to slide and wedge between the detents 281, 282, 283 when the binder 200 moves toward a closed position. FIG. 17D shows a partial side view of the binder 200 in the closed position with the locking element 272 positioned in between the faces 284 of the detents 282, so that the lateral faces 278 of the detents 282 engage the lateral faces 278' of the locking element 272. FIG. 17E and FIG. 17F show a partial side view of the binder 200 in the opened position with the locking element 272 being spaced apart and/or not between the detents 282.

Figure 18A:
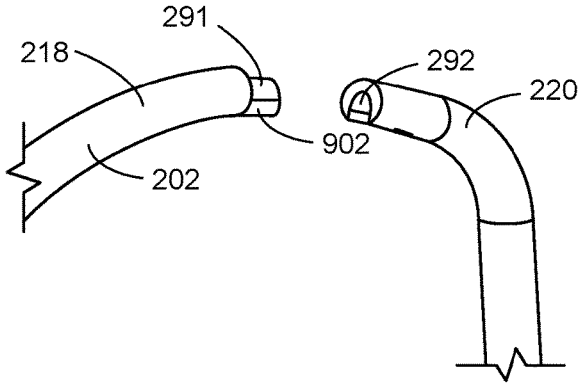
FIG. 18A-18C depict various views of the closure members of the binder apparatus of FIGS. 10A-10D in the opened position.
Figure 18B:
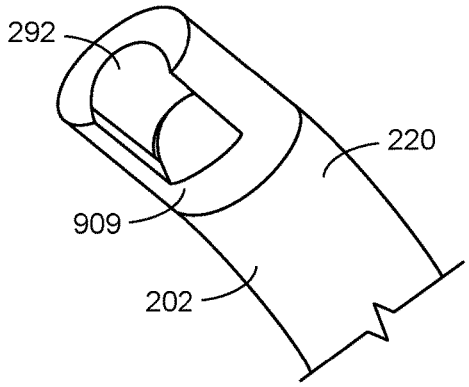
Figure 18C:
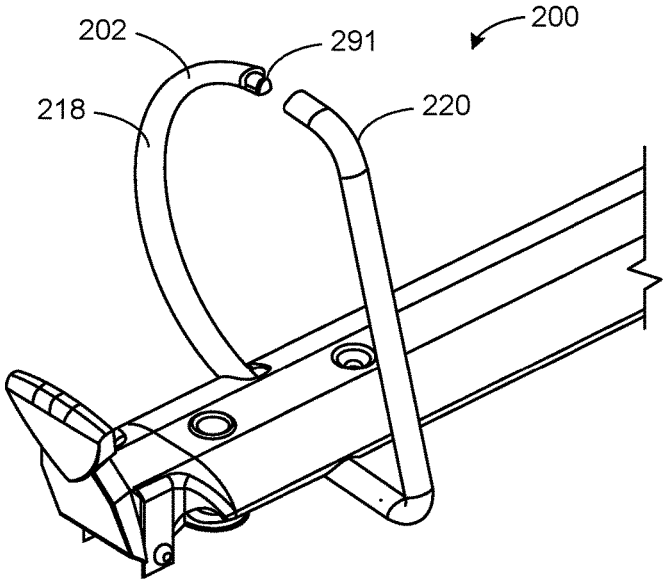
Figure 18D:
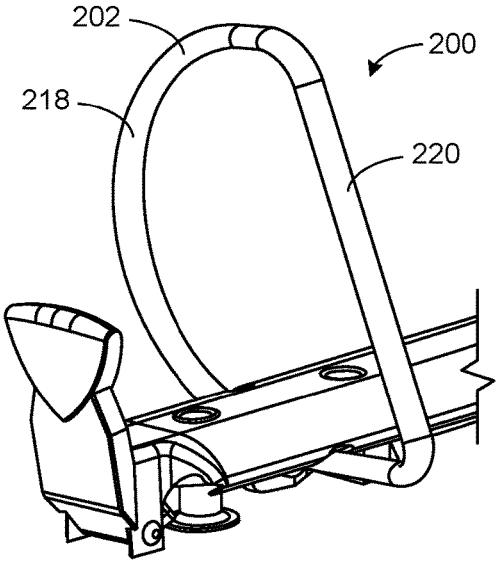
FIG. 18D depicts a perspective view of the closure members of the binder apparatus of FIGS. 10A-10D in the closed position.

FIGS. 18A-18C show multiple views of the closure member 202. Each of the closure members 102 includes the first and second portions 218 and 220. In some examples, one of the first or second portions 218, 220 has a knob and/or male portion 291 and the other of the first or second portions 220 has a groove, receptor, female portion and/or downward facing opening 292. The male portion 291 is shaped and sized such that it aligns, fits within and/or is received by the female portion 292 in a locking position, thereby securing the first and second portions 218 and 220 together. FIG. 18D shows the first and second portions 218 and 220 in a closed configuration. As the closure members 202 move from the closed position to the open position, a bottom surface 902 of the male portion 291 is positioned within and substantially flush with a surface 909 of the female portion 292, which substantially prevents a step from forming where paper could snag or tear.

Figure 19A:
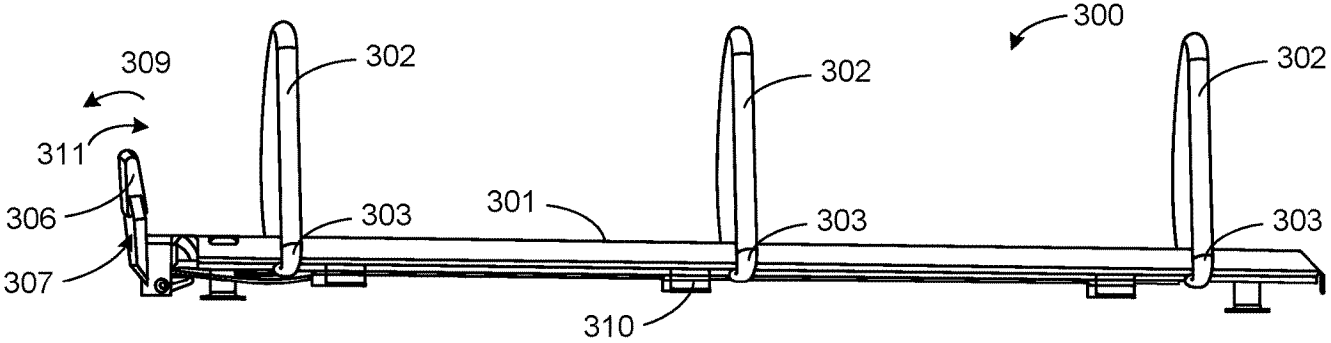
FIGS. 19A-19D depict a side elevational view, a top view, an end elevational view, and a perspective bottom view of another example binder apparatus in a closed position.
Figure 19B:
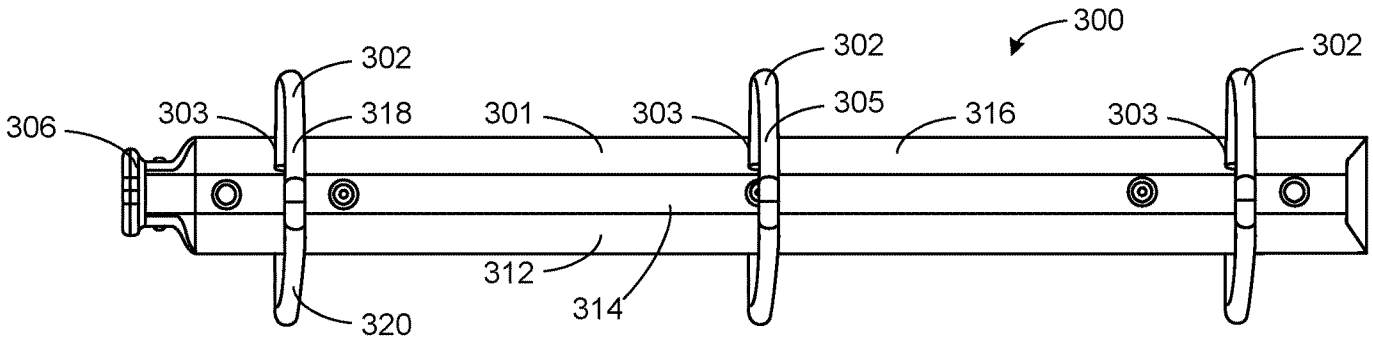

FIGS. 19A, 19B, 19C, and 19D show another example binder apparatus 300 that may be used to store loose leaf pages, documents, other materials, etc. In this example, the binder 300 includes a housing 301, one or more closure members 302 extending through openings 303 in the housing 301, and a slider 310. The closure members 302 cooperate pairwise to form at least one ring 305 (FIG. 19B). The binder 300 also includes a lever or actuating assembly 307 that may be actuated to open and close the closure members 302. Specifically, to open the closure members 302, a lever 306 of the lever 307 is moved in a direction generally represented by arrow 309 and, to close the closure members 302, the lever 306 is moved in a direction generally represented by arrow 311. However, the lever assembly 307 may be differently configured to open and/or close the closure members 302.

Figure 19C:
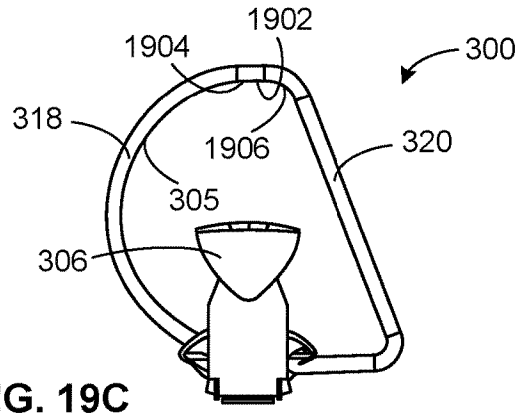

The housing 301 includes a first side or portion 312, a second side 314, and a third side or 316. The second side 314 is coupled to and positioned between the first side 312 and the third side 316. As shown in FIG. 19C, each of the closure members 302 includes a first portion or section 318 and a second portion or section 320. The first and second portions 318 and 320 engage and/or interact to form respective rings 305 that enable documents, papers, etc. to be stored within the binder 300. In the illustrated example, the second portion 320 defines groove 1902 that receives an end of the first portion 318 such that a surface 1904 of the first portion 318 is substantially flush and/or in-line with a surface 1906 of the second portion 320 even as the portions 318, 320 move toward the open position. Thus, a step may not be created between the portions 318, 320 where paper may catch or snag. In some examples, the closure members 302 may be different than shown in FIGS. 19A-19C. For example, the first and/or second portions 318 and 320 may be differently curved, have different ends, may both be similar to one another, may form a ring or any other closed shape, etc.

Figures 19D, 19E:
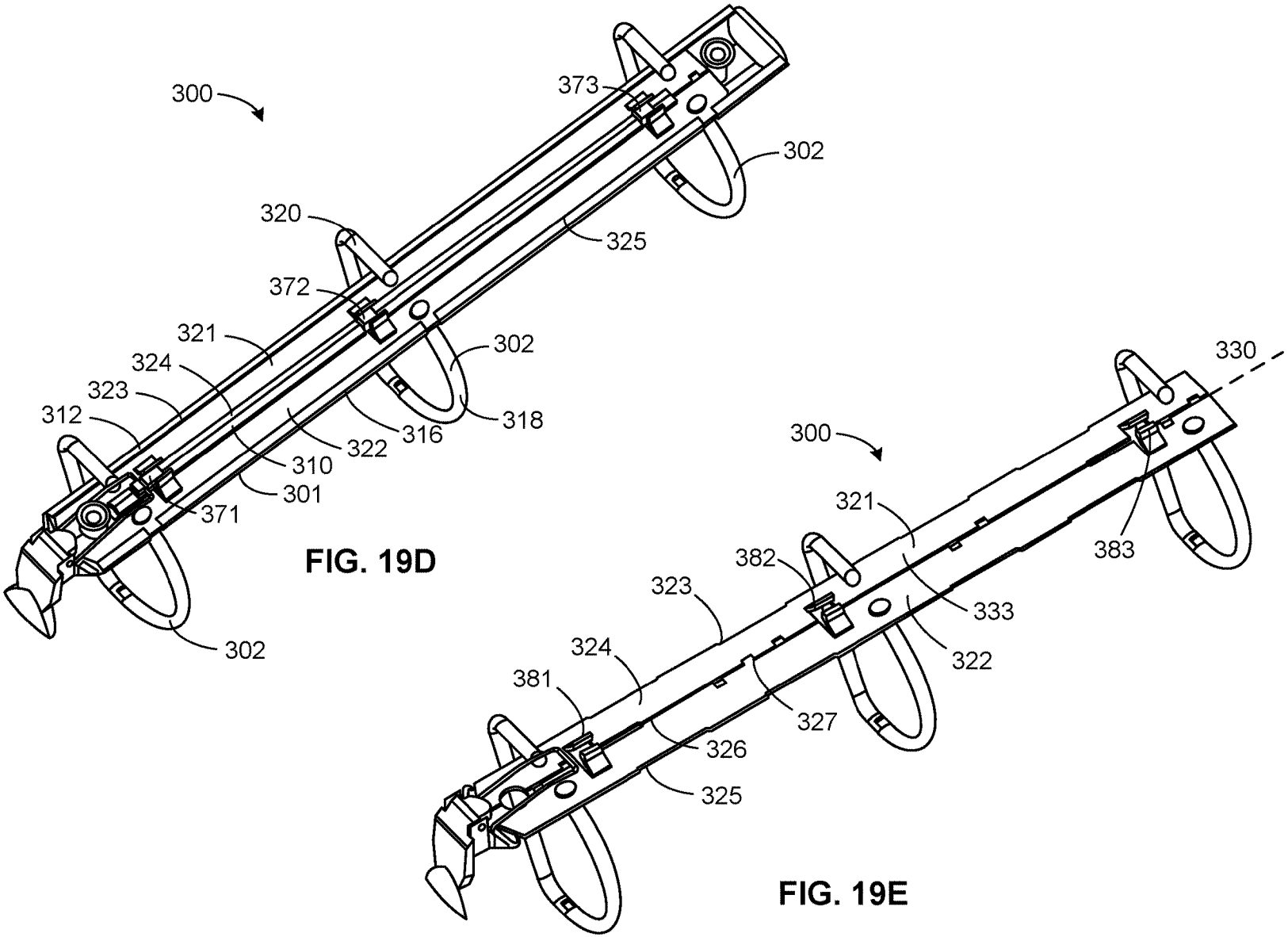
FIG. 19E depicts a perspective bottom view of the binder apparatus of FIGS. 19A-19D in the closed position without the housing.

FIGS. 19D and 19E show alternative views of the example binder 300, where FIG. 19D shows a bottom perspective of the example binder 300 with the housing 301 and the slider 310 and FIG. 19E shows a bottom perspective of the example binder 300 with the housing 301 and the slider 310 removed for illustrative purposes. The housing first and third sides 312 and 316 may have a cross sectional shape forming housing flanks (e.g., curved edges) to at least partially retain carrier rails 321 and 322 in the housing 301. The closure members 302 are respectively coupled to the carrier rails 321, 322. The first carrier rail 321 includes a first longitudinal edge 323 biased by the first side 312 of the housing 301 and a second longitudinal edge 324 that includes a plurality of notches or engaging pieces 327. The second carrier rail 322 includes a third longitudinal edge 325 biased by the third side 316 of the housing 301 and a fourth longitudinal edge 326 that includes a plurality of notches or engaging pieces 327. In other examples, one or neither of the first or the second carrier rails 321 and 322 includes the notches or engaging pieces 327. The second longitudinal edge 324 and the fourth longitudinal edge 326 may be hingably coupled via the plurality of corresponding notches or engaging pieces 327, for example.

Figures 20A, 21A:
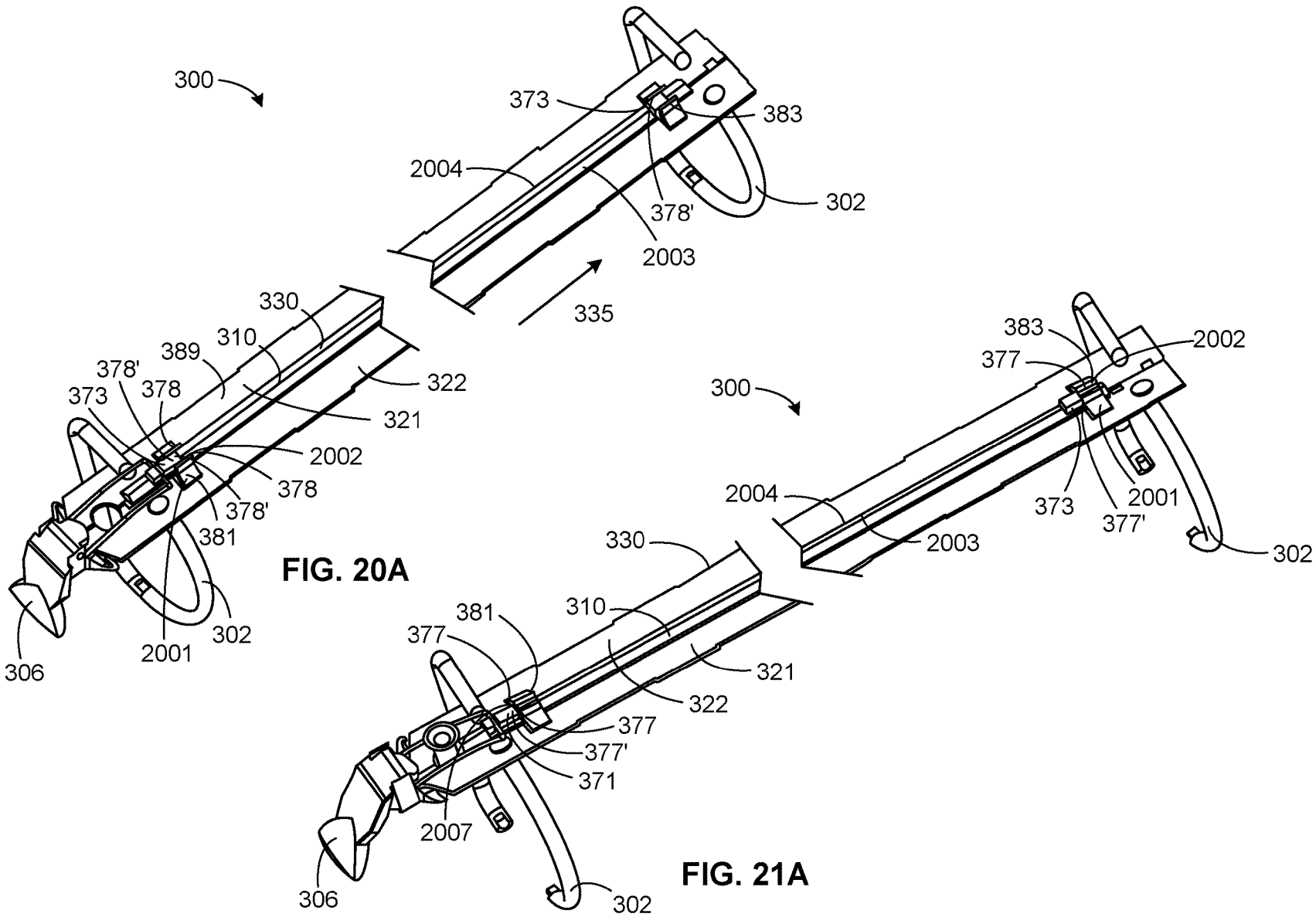
FIGS. 20A-20C depict a perspective bottom view, a side elevational view and an end elevational view of the binder apparatus of FIGS. 19A-19D in the closed position without the housing.
FIGS. 21A-21C depict a perspective bottom view, a side elevational view and an end elevational view of the binder apparatus of FIGS. 19A-19D in the opened position without the housing.

FIGS. 20A and 21A show bottom views of partial sections of the binder 300 without the housing 301. FIG. 20A shows the binder 300 in a closed position. FIG. 21A shows the binder 300 in an open position. As shown in FIG. 20A, the carrier rails 321, 322 include tabs and/or detents 381, 383 that extend substantially perpendicularly from a surface and/or face 389 of the carrier rails 321, 322. In the illustrated example, the tabs 381, 382, 383 each include a first portion 2001 and a second portion 2002. In some examples, in the closed position, the opposing portions 2002 are substantially parallel to one another. In some examples, in the open position, the portions 2001 engage tapered surfaces 2003, 2004 of the slider 310 such that the tab portions 2001 at least partially guide the movement of the slider 310. To secure the binder 300 in a closed position, the detents 381, 383 are engaged by lateral faces, surfaces, and/or edges 378' of locking block and/or elements 371, 373 such that the locking blocks 371, 373 are positioned between the detents 381, 383 and prevent ends 2007 of the detents 381, 383 from moving toward each other and, in turn, opening the closure members 102. As shown in FIG. 21A, to enable the binder 300 to be in and/or move toward the open position, the locking elements 371, 373 are spaced from between the detents 381, 383.

Figure 20C:
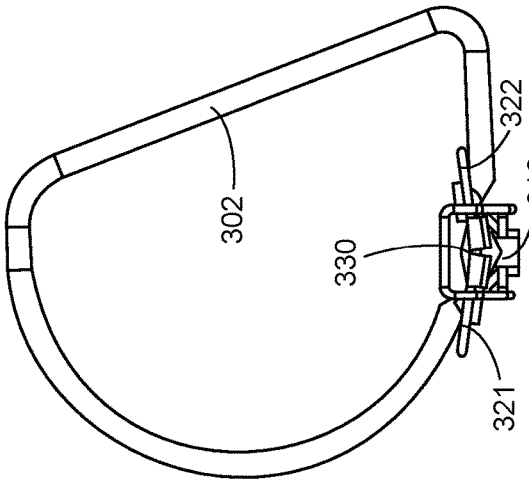
Figure 21C:
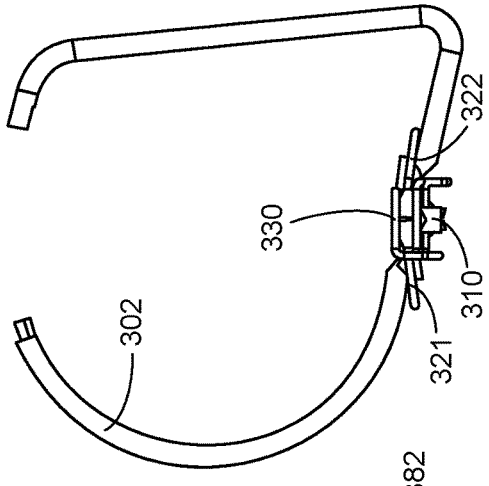
Figure 20B:
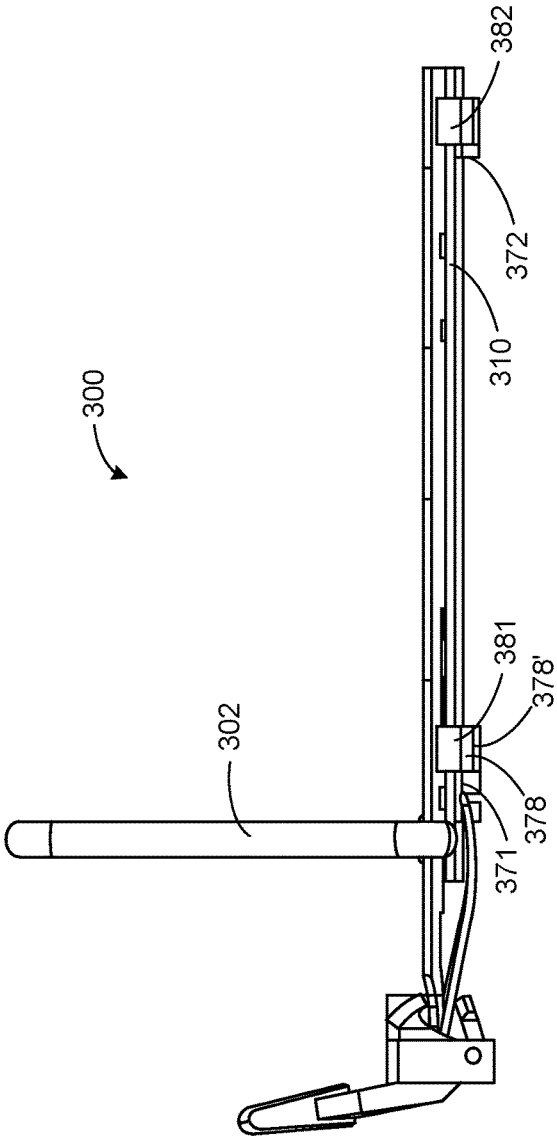
Figure 21B:
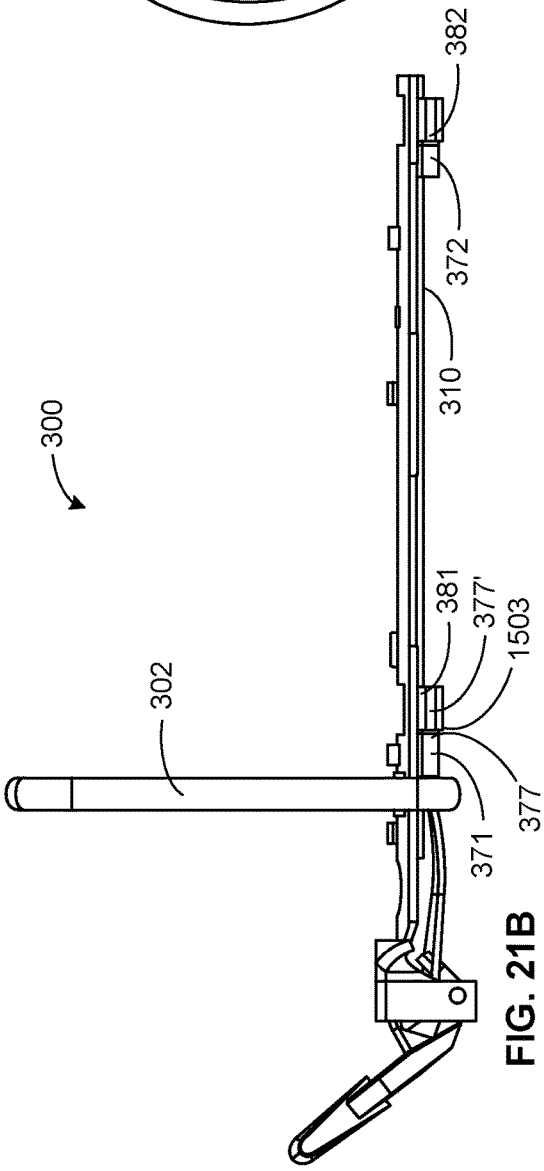

FIGS. 20B and 21B show cross-sectional side views of the binder 300 in closed and opened positions. As shown in FIG. 20B, when the binder 300 is in a closed position, the locking element 371 is positioned in between the detents 381 and the locking element 372 is positioned in between the detents 382. When the binder is closed, the lateral faces 378 of the detents 381, 382, 383 rest against the lateral faces 378' of the locking element 371. As shown in FIG. 21B, when the binder 300 is in an opened position, and the locking elements 371, 372, 373 are positioned at a distance from and/or not between the faces 377 of the detent 381 to enable respective ends 2007 of the detents 381, 382, 383 to move toward one another opening the closure members 302.

FIG. 20C shows an end view of the closure members 302, the carrier rails 321, 322 and the slider 310. When the carrier rails 321, 322 are displaced and/or pivoted about a pivot and/or axis 330, the closure members 302 are actuated between the closed and opened positions.

Figure 21D:
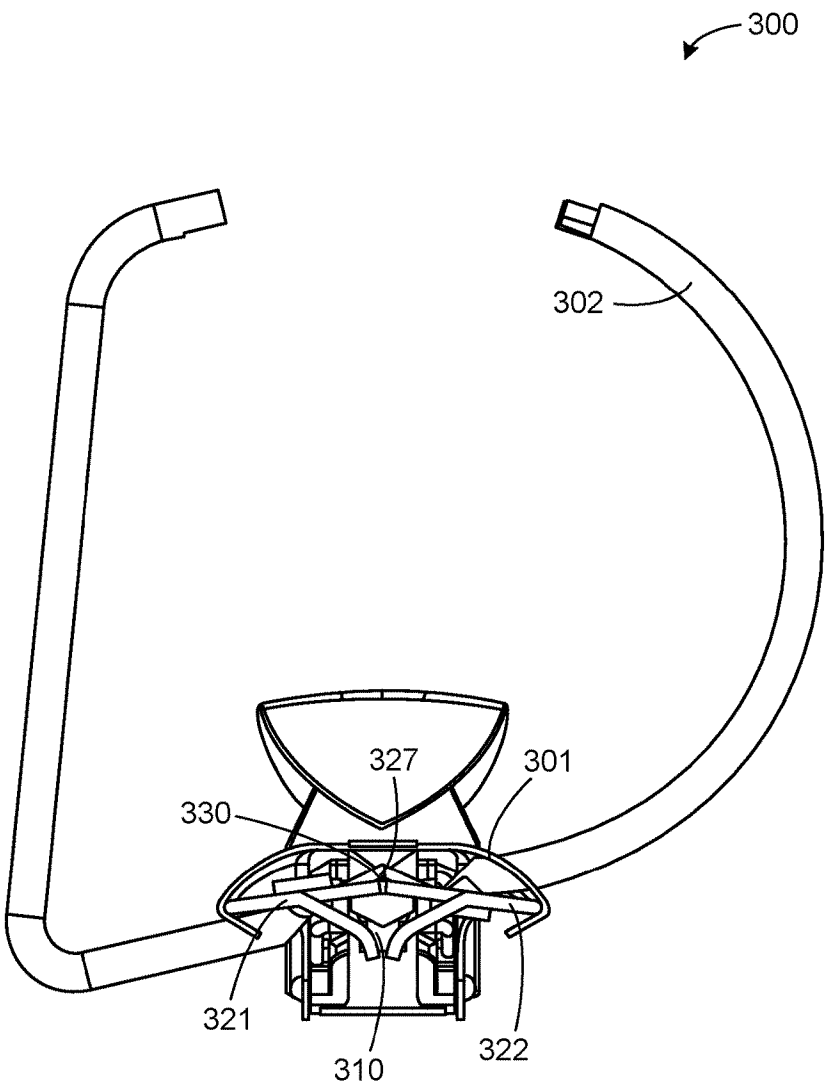
FIG. 21D depicts an enlarged end elevational view, partially in section, of the binder apparatus of FIGS. 19A-19D in the opened position.
Figure 20D:
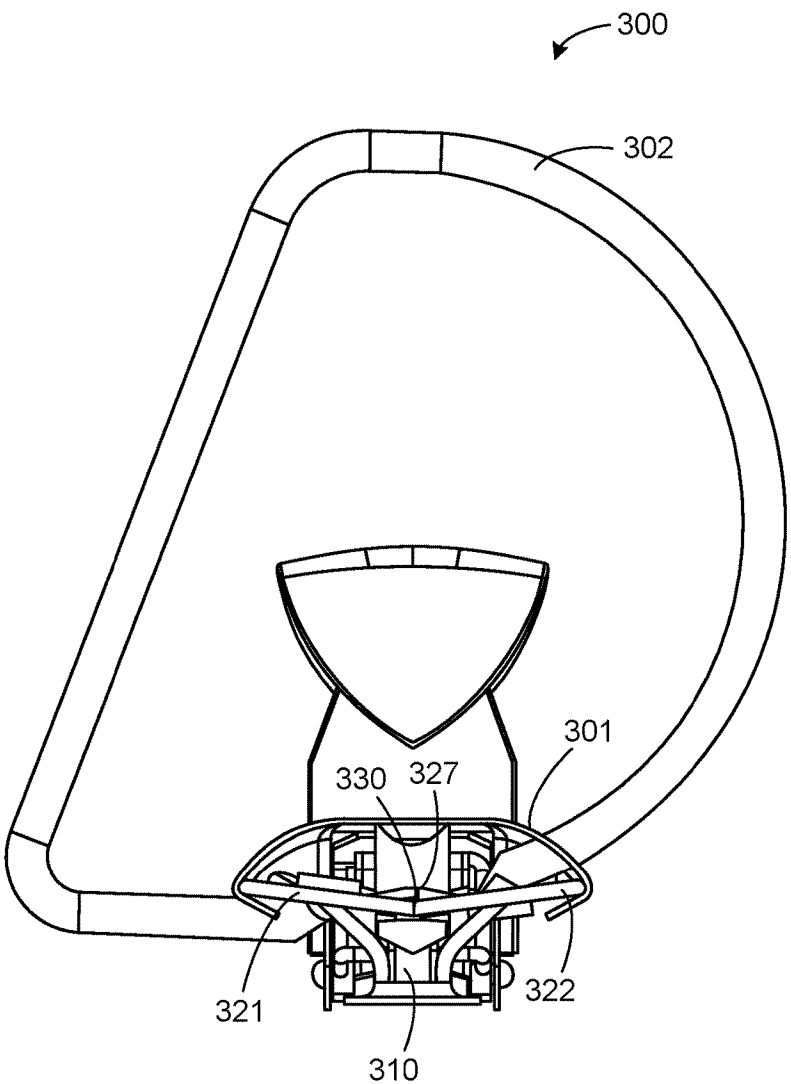
FIG. 20D depicts an enlarged end elevational view, partially in section, of the binder apparatus of FIGS. 19A-19D in the closed position.

FIGS. 20D and 21D show an end view of the binder 300 in closed and opened configurations with the housing 301, the carrier rails 321, 322, and the closure members 302. In both the opened and closed positions shown in FIGS. 20D and 21D, the carrier rails 321, 322 are hingably coupled about the longitudinal axis 330 via the plurality of corresponding notches or engaging elements 327.

Figure 22A:
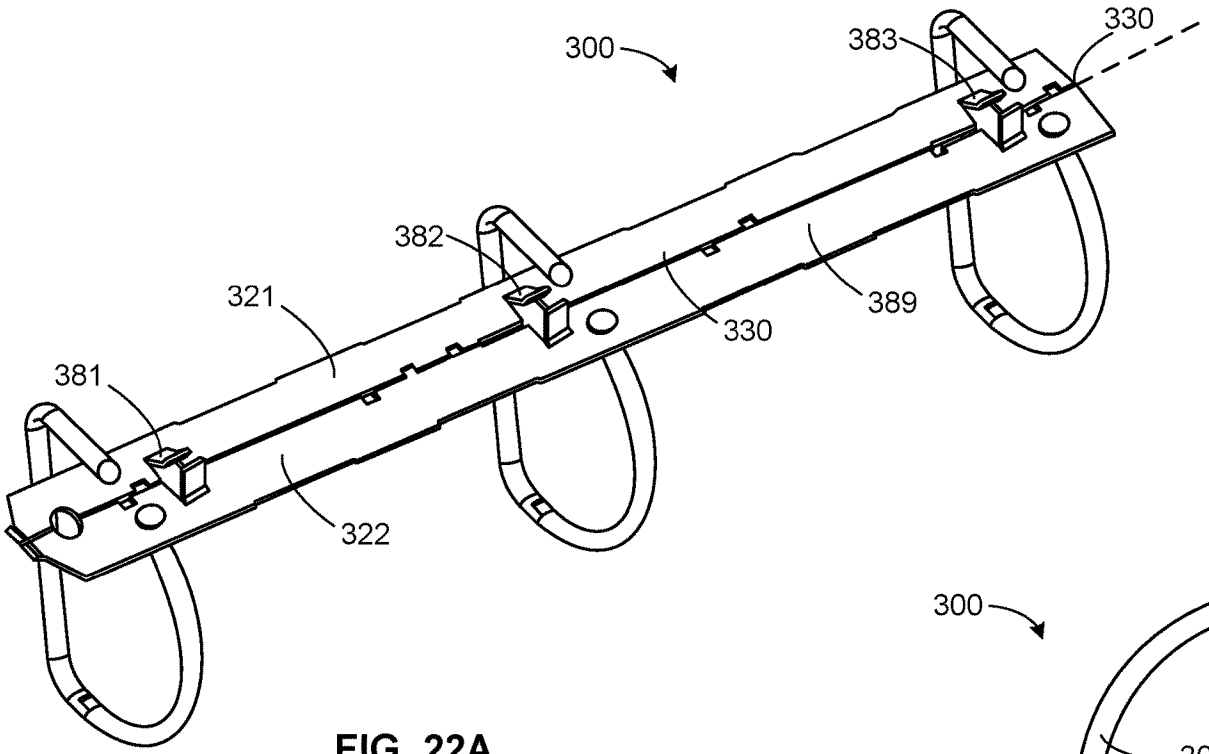
FIGS. 22A-22B depict a perspective bottom view and an end elevational view of the binder apparatus of FIGS. 19A-19D in the closed position without the slider and the housing.
Figure 22B:
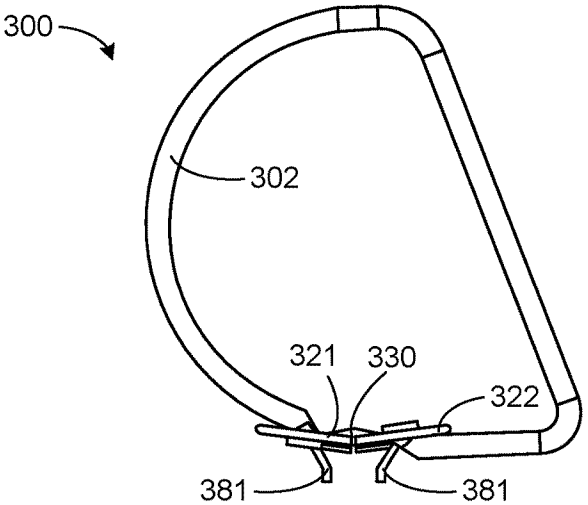

FIGS. 22A and 22B illustrate additional views of the example binder 300 with the slider 310 and the housing 301 removed. As shown in FIG. 22A, the longitudinal axis 330 extends between the carrier rails 321 and 322. As shown in FIG. 22A, the detents 281, 282, 283 extend from a surface 389 of the carrier rails 321, 322.

Figure 24A:
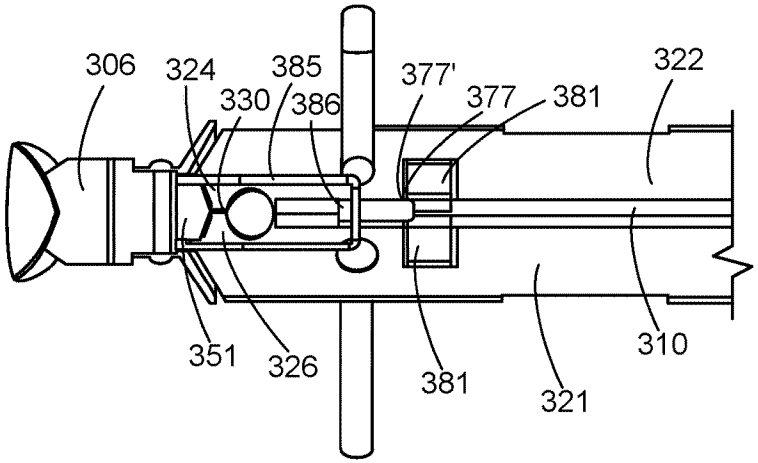
FIGS. 24A-24B depict a partial bottom view and a partial side elevational side view of the binder apparatus of FIGS. 19A-19D in the open position without the housing.
Figure 24B:
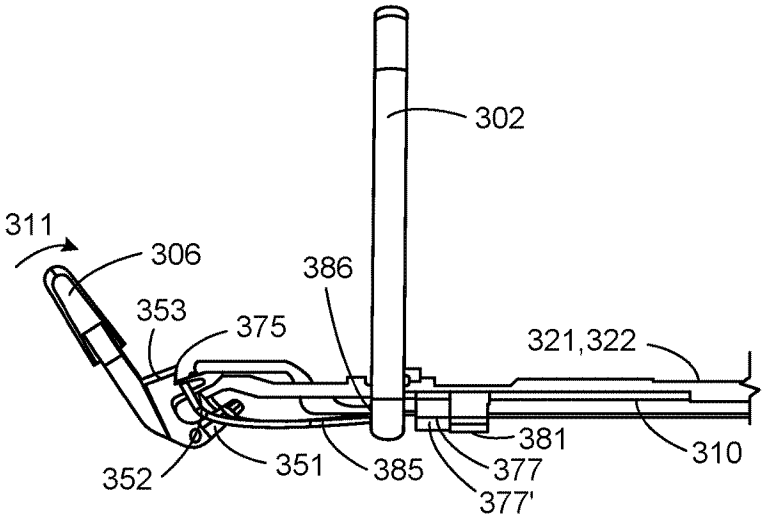
Figure 23A:
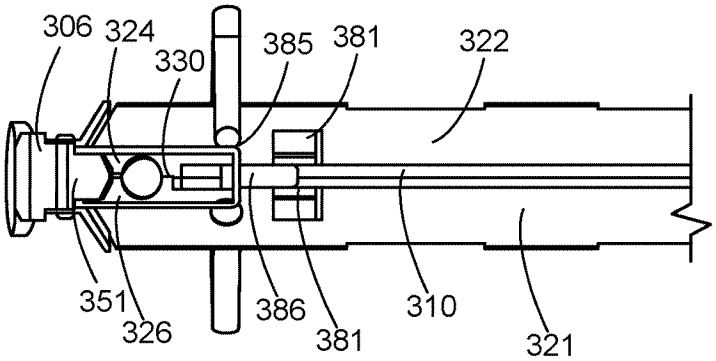
FIGS. 23A-23B depict a partial bottom view and a partial side elevational side view of the binder apparatus of FIGS. 19A-19D in the closed position without the housing.
Figure 23B:
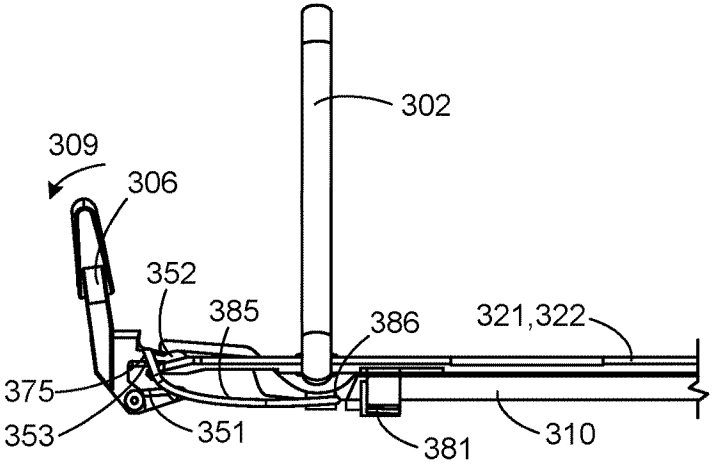

The illustrated examples of FIGS. 23A-23B show the lever 306 in a closed position, and the illustrated examples of FIGS. 24A-24B show the lever 306 in an opened position. In some examples, the lever 306 includes a lower beak 351 and an upper beak 352. As shown in FIG. 23B, when the lever 306 moves from the closed position to the open position in a direction generally indicated by arrow 309, the slider 310 via an intermediate connector 385 moves the locking elements 371, 373 away from being between the detents 381, 383. In some examples, when the lever 306 is pulled and/or moved in the direction generally represented by arrow 309 from the closed to the opened position, the lower beak 351 pushes the inner edges 324 and 326 of the carrier rails 321 and 322 toward the second portion 314 of the housing 301, which pivots the carrier rails 321 and 322 relative to the longitudinal axis 330 (see FIG. 22B) and moves the closure members 302 toward the open position. As shown in FIGS. 23A-23B, intermediate connector 385 extends from the upper beak 352 to a groove and/or latch 386 on the slider 310. The intermediate connector 385 connects the upper beak 352 to the slider 310, such that pulling the lever 306 in the direction generally represented by arrow 309 enables the slider 310 to move therewith. As shown in FIG. 24A-24B, when the lever 306 is moves moved in a direction 311 from the opened to the closed position, the upper beak 352 moves the inner longitudinal edges 324 and 326 of the carrier rails 321 and 322 away from the center section 314 of the housing 301, which causes the carrier rails 321 and 322 to pivot relative to the longitudinal axis 330, and move the closure members 302 toward the closed position. As shown in FIGS. 23A-23B, when the slider 310 is in the closed position, the locking element 371 engages between the detents 381. As shown in FIG. 24A-24B, when the slider 310 is in the opened position, the longitudinal faces 377' of the locking element 371 engage the longitudinal faces 377 of the detent 381.

As shown in FIGS. 23B and 24B, in some examples, the lever 306 has an aperture, slot and/or groove 353 to receive a bar and/or portion 375 of the intermediate connector 385. When the binder 300 is in an open position, the intermediate connector 385 is in a first, unflexed and/or relaxed state. Initially, when the lever 306 is moved from the open position to the closed position in a direction generally indicated by arrow 311, the upper beak 352 moves toward the carrier rails 321, 322, the bar 375 remains within the aperture 353 of the lever 306, and the intermediate connector 385 transitions into a flexed and/or unrelaxed state, enabling the slider 310 to remain in the second position and/or remain substantially stationary as the carrier rails 321, 322 initially pivot from the opened position to the closed position. As the carrier rails 321, 322 move into the closed position, the detents 381, 382, 383 move apart laterally, and a space between the detents 381, 382, 383 increases until the space is greater than the width of the locking elements 371, 372, 373. Once the space between the detents 381, 382, 383 is greater than the width of the locking elements 371, 372, 373, the wire 385 biases and/or moves the slider 310 and locking elements 371, 372, 373 into the closed position and the locking elements 371, 372, 373 in between the detents 381, 182, 183. Enabling a delay of the movement of the slider 310 as the carrier rails 321, 322 initially translate from the open to the closed position substantially prevents the binder 300 from jamming. The binder 300 may also transition from the open to closed position by actuating the closure members 302. In the closed position, the locking elements 371, 372, 373 may be positioned between the detents 381, 382, 383 to prevent the carrier rails 321, 322 from pivoting and/or the binder 300 from opening.

Figures 25A, 25B, 25C, 25D:
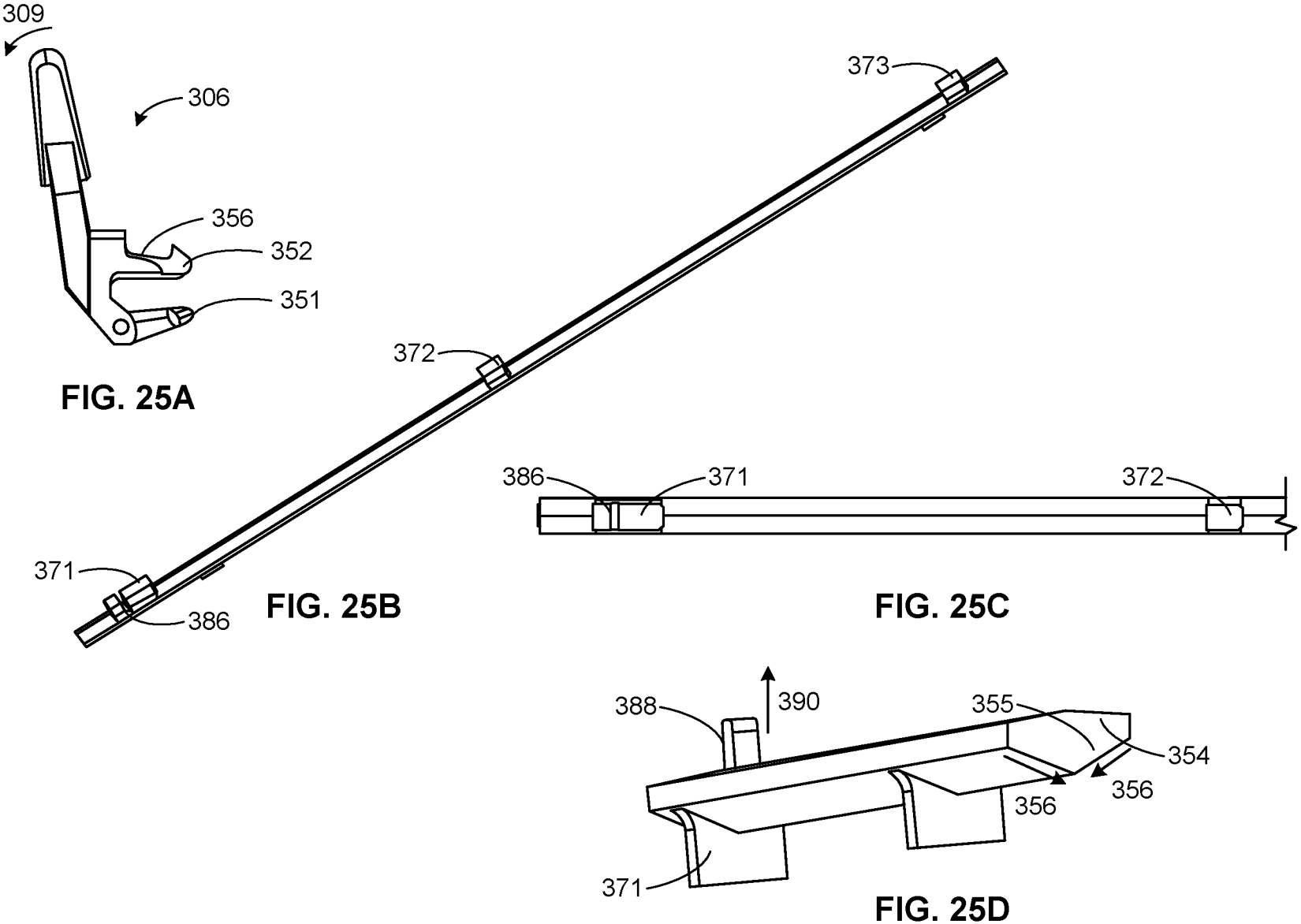
FIGS. 25A-25D depict a side elevational view of an example lever, a perspective view of the example slider, a partial top view of the slider, and a perspective cross-sectional view of the slider of the binder apparatus of FIGS. 19A-19D.

FIGS. 25A-25D show alternative views of the lever 306 and the slider 310 with the housing 301 and the carrier rails 302 removed. As shown in FIG. 25A, in some examples, the upper beak 352 includes a groove 356 where the intermediate connector 385 (see FIG. 23A-23B) engages and/or couples with the upper beak 352. As shown in FIG. 25D, in some examples, the slider 310 also includes at least one guide 388 that extends in an interior direction generally represented by arrow 390 and interacts with the carrier rails 321, 322 to guide the slider 310 along the longitudinal axis 330 of the carrier rails 321, 322 (see FIG. 22A). As shown in FIG. 25B, the slider 310 also includes the groove 386 (see also FIGS. 23A-23B) and the locking elements 371, 372 and 373. As shown in FIG. 25D, in some examples, the slider 310 has a cross-section 354 that includes slanted exterior faces 355, which enable the detents 381, 382, 383 (see FIG. 22A) to engage the slider 310 in a diagonal direction generally represented by arrows 356. At least in some examples, a portion of the slider 310 has a triangular cross-section.

FIGS. 26A and 26B show isometric perspectives of the carrier rails 321, 322, the intermediate connector 385 and the slider 310. As shown in FIG. 26A, the guides and/or tabs 388 of the slider 310 link with and/or received by a groove 388' defined between the carrier rails 321, 322. As shown in FIG. 26B, the intermediate connector 385 connects with the slider 310 at the groove 386.

FIGS. 26C-26F show various partial views of the carrier rails 321, 322, the locking element 372 and the detents 382. FIG. 26C shows a partial bottom view of the binder 300 in the closed position with the locking element 372 positioned in between the detents 382 and, thus, substantially preventing the carrier rails 321, 322 from transitioning to the open position. The detents 382 have inner lateral faces, surfaces, and/or edges 378 that engage the lateral faces 378' of the locking element 372. As shown in FIG. 26C, in the closed position the lateral faces 378 of the detents 382 and the lateral faces 378' of the locking element 372 are substantially parallel with one another and/or relative to the longitudinal axis 330, which enables the exterior surface 178 of the locking element 372 to fully engage and/or exert an outward force on the surfaces 178' that substantially prevents the closure members 302 from opening. FIG. 26D shows a partial side view of the binder 300 in the closed position with the locking element 372 positioned in between the detents 382, so that the lateral faces 378 of the detents 382 engage the lateral faces 378' of the locking element 372. FIG. 26E shows a partial side view of the binder 300 in the opened position with the locking element 372 positioned such that the locking element 372 is spaced apart from and/or not between the detents 382 and, thus, enabling the carrier rails 321, 322 to transition from the closed position to the open position. FIG. 26F shows a partial side view of the binder 300 in the opened position with the locking element 372 positioned such that the locking element 372 is spaced apart and/or not between the detents 182.

Figure 27A:
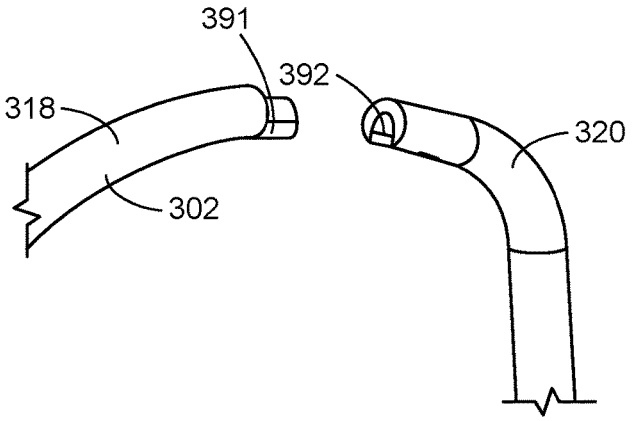
FIG. 27A-27C depict various views of the closure members of the binder apparatus of FIGS. 19A-19D in the opened position.
Figure 27B:
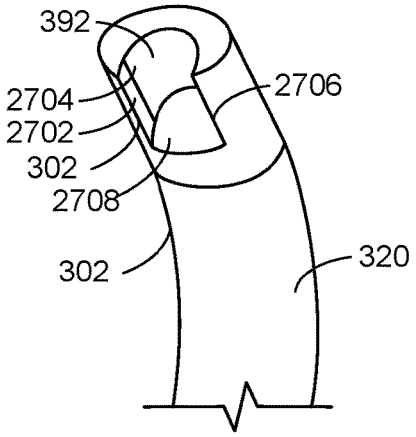
Figure 27C:
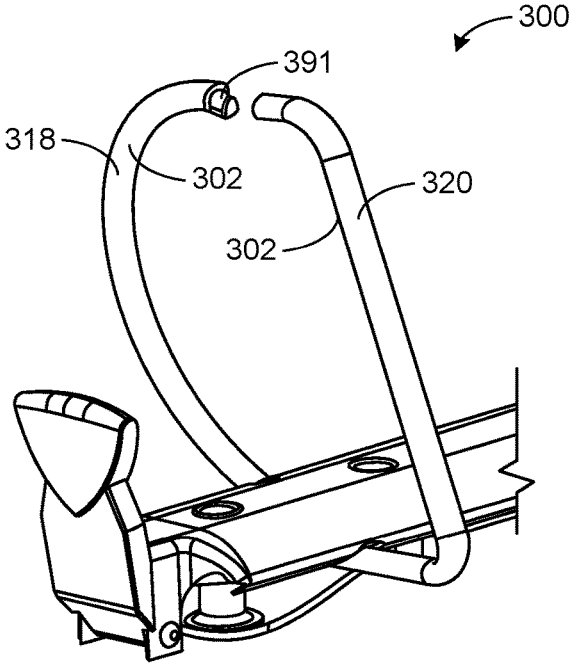
Figure 27D:
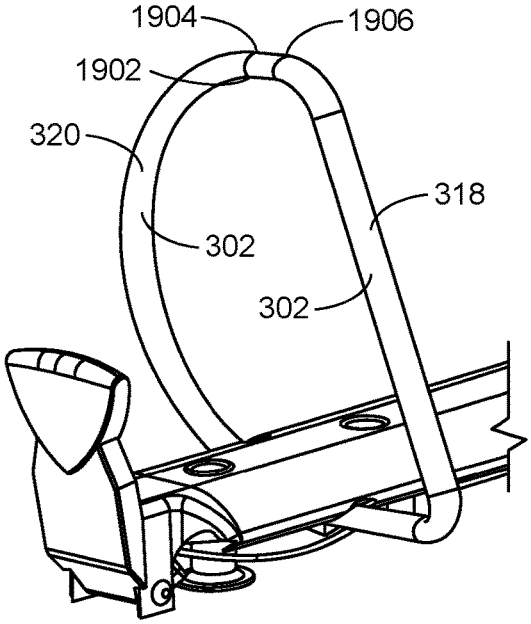
FIG. 27D depicts a perspective view of the closure members of the binder apparatus of FIGS. 19A-19D in the closed position.

FIGS. 27A-27C show multiple views of a closure member 302. Each of the closure members 302 includes the first and second portions 318 and 320. In some examples, one of the first or second portions 318, 320 has a knob and/or male portion 391 and the other of the first or second portions 320 has a groove, receptor, female portion and/or a downward facing opening 392. As shown in FIG. 27B, the female portion 392 include a first sidewall or surface 2702, a second sidewall or surface 2704, a third sidewall or surface 2706, and a fourth wall or surface 2708. The male portion 391 is shaped and sized such that the knob 391 aligns and fits within the female portion 392 in a locking position, securing the first and second portions 318 and 320 of the closure member 302 together. As the closure members 302 move from the closed position to the open position, a bottom surface 1902 of the male portion 391 is positioned within and substantially flush with a surface 1904 of the female portion 392 which substantially prevents a step from forming where paper could hang up and/or tear. FIG. 27D shows the closure members 302 in a closed position.

In some example, an example ring binder that is secured and/or coupled to a cover includes a pair of hingably engaged plates supported by a housing. In some examples, half-rings are coupled to the respective carrier rails. The plates are pivotable between an open configuration in which the half-rings are open and a closed configuration in which the half-rings are closed. A lever is coupled to a slider that moves relative to the plates to secure the plates in the closed configuration. In some examples, the lever defines a slot in which an end of the slider is positioned. As the ring binder moves between the open and/or closed configurations, the end of the slider transitions and/or moves within the slot.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. A binder apparatus, comprising:

a housing having a first side surface, a second side surface, and an inner central surface extending between the first side surface and the second side surface;

a first carrier rail including a first longitudinal edge and a second longitudinal edge, the first carrier rail including a first tab to extend away from the inner central surface of the housing, the first longitudinal edge disposed adjacent the first side surface of the housing;

a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingeably engaging the fourth longitudinal edge, wherein the first tab has a first portion that extends perpendicular from the first carrier rail and a second portion that extends parallel to the first carrier rail, and wherein the second tab has a first portion that extends perpendicular from the second carrier rail and a second portion that extends parallel to the second carrier rail; and a slider including a locking block, the locking block disposed in a space between the first tab and the second tab when the binder apparatus is in a closed position and the locking block is disposed outside of the space between the first tab and the second tab when the binder apparatus is in an open position, wherein at least a portion of the locking block is disposed between the second portion of the first tab and the second portion of the second tab when the binding apparatus is in the closed position.

2. The binder apparatus of claim 1, wherein the first portion of the first tab extends away from the inner central surface of the housing and the first portion of the second tab extends away from the inner central surface of the housing.

3. A binder apparatus, comprising:

a housing having a first side surface, a second side surface, and an inner central surface extending between the first side surface and the second side surface;

a first carrier rail including a first longitudinal edge and a second longitudinal edge, the first carrier rail including a first tab to extend away from the inner central surface of the housing, the first longitudinal edge disposed adjacent the first side surface of the housing;

a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingeably engaging the fourth longitudinal edge;

a slider including a locking block, the locking block disposed in a space between the first tab and the second tab when the binder apparatus is in a closed position and the locking block is disposed outside of the space between the first tab and the second tab when the binder apparatus is in an open position;

a first closure member coupled to the first carrier rail; and a second closure member coupled to the second carrier rail, wherein the first closure member and the second closure member engage when the binder apparatus is in a closed position, and wherein the locking block is disposed a first distance from the first closure member and the second closure member when the binder apparatus is in the closed position and the locking block is disposed a second distance from the first closure member and the second closure member when the binder apparatus is in the open position, the second distance different from the first distance.

4. The binder apparatus of claim 3, wherein the second distance is less than the first distance.

5. The binder apparatus of claim 3, wherein the locking block is disposed on a first side of the slider and the slider further includes a bracket disposed on a second side of the slider, the binder apparatus further including a lever to engage the bracket to move the slider.

6. The binder apparatus of claim 3, wherein the locking block is disposed beneath the first carrier rail and the second carrier relative to the inner central surface of the housing when the binder apparatus is in the closed position and the locking block is disposed beneath the first carrier rail and the second carrier rail when the binder apparatus is in the open position.

7. The binder apparatus of claim 3, wherein the first tab and the second tab are separated a first distance when the binder apparatus is in the closed position and the first tab and the second tab are separated a second distance when the binder apparatus is in the open position, the second distance different than the first distance.

8. The binder apparatus of claim 7, wherein the second distance is less than the first distance.

9. The binder apparatus of claim 8, wherein the locking block has a first side that has a length between the first distance and the second distance.

10. The binder apparatus of claim 9, wherein the locking bock has a second side that has a length greater than the first distance.

11. The binder apparatus of claim 3, wherein the slider further includes a body that is to slide between the first tab and the second tab.

12. The binder apparatus of claim 3, wherein the first tab has a first portion that extends perpendicular from the first carrier rail and a second portion that extends parallel to the first carrier rail, and wherein the second tab has a first portion that extends perpendicular from the second carrier rail and a second portion that extends parallel to the second carrier rail.

13. The binder apparatus of claim 3, wherein the first tab is disposed adjacent the second longitudinal edge and the second tab is disposed adjacent the fourth longitudinal edge.

14. A binder apparatus, comprising:

a housing having a first side surface, a second side surface, and an inner central surface extending between the first side surface and the second side surface;

a first carrier rail including a first longitudinal edge and a second longitudinal edge, the first carrier rail including a first tab to extend away from the inner central surface of the housing, the first longitudinal edge disposed adjacent the first side surface of the housing;

a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingeably engaging the fourth longitudinal edge, wherein the first tab has a first inwardly facing surface and the second tab has a second inwardly facing surface, the first inwardly facing surface non-parallel relative to the second inwardly facing surface; and a slider including a locking block, the locking block disposed in a space between the first tab and the second tab when the binder apparatus is in a closed position and the locking block is disposed outside of the space between the first tab and the second tab when the binder apparatus is in an open position.

15. A binder apparatus, comprising:

a housing having a first side surface, a second side surface, and an inner central surface extending between the first side surface and the second side surface;

a first carrier rail including a first longitudinal edge and a second longitudinal edge, the first carrier rail including a first tab to extend away from the inner central surface of the housing, the first longitudinal edge disposed adjacent the first side surface of the housing;

a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingeably engaging the fourth longitudinal edge; and a slider including a locking block, the locking block disposed in a space between the first tab and the second tab when the binder apparatus is in a closed position and the locking block is disposed outside of the space between the first tab and the second tab when the binder apparatus is in an open position, wherein the locking block includes a trapezoidal surface.

16. A binder apparatus, comprising:

a housing having a first side surface, a second side surface, and an inner central surface extending between the first side surface and the second side surface;

a first carrier rail including a first longitudinal edge and a second longitudinal edge, the first carrier rail including a first tab to extend away from the inner central surface of the housing, the first longitudinal edge disposed adjacent the first side surface of the housing;

a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingeably engaging the fourth longitudinal edge; and a slider including a locking block, the locking block disposed in a space between the first tab and the second tab when the binder apparatus is in a closed position and the locking block is disposed outside of the space between the first tab and the second tab when the binder apparatus is in an open position, wherein the locking block is disposed on a first side of the slider and the slider further includes a bracket disposed on a second side of the slider, the binder apparatus further including a lever to engage the bracket to move the slider, wherein the locking block extends away from the inner central surface of the housing and the bracket extends toward the inner central surface of the housing.

17. A binder apparatus, comprising:

a housing having a first side surface, a second side surface, and an inner central surface extending between the first side surface and the second side surface;

a first carrier rail including a first longitudinal edge and a second longitudinal edge, the first carrier rail including a first tab to extend away from the inner central surface of the housing, the first longitudinal edge disposed adjacent the first side surface of the housing;

a second carrier rail including a third longitudinal edge and a fourth longitudinal edge, the second carrier rail including a second tab to extend away from the inner central surface of the housing, the third longitudinal edge disposed adjacent the second side surface of the housing, the second longitudinal edge hingeably engaging the fourth longitudinal edge; and a slider including a locking block, the locking block disposed in a space between the first tab and the second tab when the binder apparatus is in a closed position and the locking block is disposed outside of the space between the first tab and the second tab when the binder apparatus is in an open position, wherein the locking block includes a first side and a second side converging with the first side.

* * * * *